US009266162B2

(12) United States Patent
Tanaka et al.

(10) Patent No.: US 9,266,162 B2
(45) Date of Patent: Feb. 23, 2016

(54) PRESS-FORMING METHOD OF COMPONENT WITH L SHAPE

(75) Inventors: Yasuharu Tanaka, Tokyo (JP); Takashi Miyagi, Tokyo (JP); Misao Ogawa, Tokyo (JP); Shigeru Uchiyama, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 446 days.

(21) Appl. No.: 13/575,061

(22) PCT Filed: May 19, 2011

(86) PCT No.: PCT/JP2011/061504

§ 371 (c)(1),
(2), (4) Date: Jul. 25, 2012

(87) PCT Pub. No.: WO2011/145679

PCT Pub. Date: Nov. 24, 2011

(65) Prior Publication Data

US 2012/0297853 A1 Nov. 29, 2012

(30) Foreign Application Priority Data

May 19, 2010 (JP) ..... P2010-115208

(51) Int. Cl.
*B21D 22/02* (2006.01)
*B21D 22/20* (2006.01)
(Continued)

(52) U.S. Cl.
CPC ..... *B21D 22/02* (2013.01); *B21D 22/20* (2013.01); *B21D 22/21* (2013.01); *B21D 22/22* (2013.01); *B21D 24/02* (2013.01); *B21D 24/04* (2013.01); *B21D 53/88* (2013.01)

(58) Field of Classification Search
CPC ..... B21D 22/02; B21D 22/06; B21D 22/10; B21D 5/01; B21D 5/04; B21D 25/00; B21D 25/02; B21D 25/04; B21D 22/20; B21D 22/21; B21D 22/22; B21D 24/02; B21D 24/04; B21D 22/26
USPC ..... 72/293, 311, 312, 343, 347, 350, 352, 72/353.2, 358, 386, 388, 389.1, 389.2, 72/474, 475, 380, 381
See application file for complete search history.

(56) References Cited

U.S. PATENT DOCUMENTS 5,014,537 A * 5/1991 Nine ..... 72/350
5,211,047 A * 5/1993 Kaneyuki ..... 72/347
(Continued)

FOREIGN PATENT DOCUMENTS

DE 19853130 A1 * 5/2000 ..... B21D 22/02
DE 10318056 A1 11/2004
(Continued)

OTHER PUBLICATIONS

Nakagawa et al., "Stamping Simulation of Laser-Welded, High Strength Steel Blanks", Journal of the JSTP, vol. 35, No. 404, 1994, pp. 1115-1121.
(Continued)

*Primary Examiner* — Shelley Self
*Assistant Examiner* — Pradeep C Battula
(74) *Attorney, Agent, or Firm* — Birch, Stewart, Kolasch & Birch, LLP

(57) ABSTRACT

A forming method that forms a press component with an L shape from a blank metal sheet, the press component having a top sheet section and a vertical wall section which is connected to the top sheet section via a bent section having a part curved in an arc shape and which has a flange section on an opposite side to the bent section, the top sheet section being arranged on an outside of the arc of the vertical wall section, the method including: disposing the blank metal sheet between a die and both of a pad and a bending die; and forming the vertical wall section and the flange section while at least a part of the blank metal sheet is caused to slide on a part of the die corresponding to the top sheet section.

29 Claims, 35 Drawing Sheets

(51) Int. Cl.

| | |
|---|---|
| ***B21D 22/22*** | (2006.01) |
| ***B21D 24/04*** | (2006.01) |
| ***B21D 53/88*** | (2006.01) |
| ***B21D 22/21*** | (2006.01) |
| ***B21D 24/02*** | (2006.01) |

(56) References Cited

U.S. PATENT DOCUMENTS

| | | | | |
|---|---|---|---|---|
| 7,971,467 | B2 * | 7/2011 | Yamada | B21D 5/01 72/356 |
| 2009/0049886 | A1 | 2/2009 | Okuzumi et al. | |
| 2013/0239645 | A1 * | 9/2013 | Tanaka | B21D 22/26 D22/26 |

FOREIGN PATENT DOCUMENTS

| | | | | | |
|---|---|---|---|---|---|
| JP | 01066024 | A | * | 3/1989 | B21D 24/04 |
| JP | 8-66730 | A | | 3/1996 | |
| JP | 2003-103306 | A | | 4/2003 | |
| JP | 2004-154859 | A | | 6/2004 | |
| JP | 2005-186154 | A | | 7/2005 | |
| JP | 2006-15404 | A | | 1/2006 | |
| JP | 2008-307557 | A | | 12/2008 | |
| JP | 101372025 | A | | 2/2009 | |
| JP | 2009-255116 | A | | 11/2009 | |
| JP | 2010-036217 | A | | 2/2010 | |
| RU | 2292976 | C2 | | 10/2007 | |
| SU | 741997 | A1 | | 6/1980 | |
| SU | 884796 | A1 | | 11/1981 | |

OTHER PUBLICATIONS

European Patent Search Report dated Sep. 30, 2011, issued in European Patent Application No. 11166738.2, (6 pages).

PCT/ISA/210—International Search Report mailed on Jul. 26, 2011, issued in PCT/JP2011/061504.

Japanese Office Action for JP Appl. No. 2012-223589 issued Apr. 22, 2014 (w/Engl. translation).

Chinese Office Action for corresponding Chinese Application No. 201180008229.4 dated Jan. 6, 2014 (with English translation of Search Report).

A.P.Nefedov, Design and Manufacture of Pressing Tools, Mechanical Engineering Publishers, pp. 78-79 (1973).

Notice of Allowance dated Aug. 8, 2014 and its translation for Russian Application No. 2012133251.

* cited by examiner

PRE-PROCESSED SHAPE EXAMPLES 37 AND 38

PRESS-FORMING METHOD OF COMPONENT WITH L SHAPE

TECHNICAL FIELD

The present invention relates to a press-forming method of a component with an L shape used as a framework member or the like of an automobile.

The present application claims priority on Japanese Patent Application No. 2010-115208, filed in Japan on May 19, 2010, the contents of which are cited herein by reference.

DESCRIPTION OF RELATED ART

An automobile framework structure is formed by joining framework members such as a front pillar reinforcement, a center pillar reinforcement, or a side sill outer reinforcement manufactured by press-forming a blank metal sheet. For example, FIG. 1 shows a framework structure 100 formed by joining framework members 110, 120, 130, and 140 by spot welding. The framework member 110 has an L shape including a top sheet section 111, a vertical wall section 112, and a flange section 113, thereby ensuring strength and rigidity of the framework structure 100.

In general, when a component having an L shape (hereinafter, sometimes called an L-shaped component) such as the framework member 110 is press-formed, a drawing method is employed in order to suppress generation of wrinkles. In the drawing method, as shown in (a) and (b) of FIG. 3, a blank metal sheet 300A is drawn into a formed body 300B by using a die 201, a punch 202, and a blank holder 203 (holder). For example, when a component 300 shown in FIG. 4A is manufactured by the drawing method, (1) the blank metal sheet 300A shown in FIG. 4B is disposed between the die 201 and the punch 202, (2) a clamped area T in the periphery of the blank metal sheet 300A shown in FIG. 4C is strongly clamped by the blank holder 203 and the die 201, (3) the blank metal sheet 300A is drawn formed into a drawn body 300B shown in FIG. 4D by relatively moving the die 201 and the punch 202 in a press direction (vertical direction), and (4) unnecessary portions of the periphery of the drawn body 300B are trimmed, thereby obtaining the component 300. By this drawing method, a flow of a metal material of the blank metal sheet 300A can be controlled by the blank holder 203, and therefore generation of wrinkles due to an excessive inflow of the blank metal sheet 300A can be suppressed. However, since a large trim area is needed in the periphery of the blank metal sheet 300A, the yield is reduced, resulting in an increase in costs. In addition, during the drawing, in the drawn body 300B, as shown in FIG. 5, wrinkles are more likely to be generated in an area ($\alpha$ area) into which the metal material excessively flows, and cracks are more likely to be generated in an area ($\beta$ area) in which the thickness is locally reduced. In order to prevent such cracks and wrinkles, typically, a metal sheet having excellent ductility and relatively low strength needs to be used as the blank metal sheet 300A.

As described above, a blank metal sheet to be drawn requires high ductility. For example, when a steel sheet having small ductility and high strength is used as the blank metal sheet to draw an L-shaped component, cracks or wrinkles are likely to be generated due to insufficient ductility. Accordingly, typically, the L-shaped component such as a front pillar reinforcement or a center pillar reinforcement is manufactured using a steel sheet having excellent ductility and relatively low strength as the blank metal sheet. Therefore, in order to ensure strength, the thickness of the blank metal sheet needs to be high, so that there is a problem with increases in component weight and costs. Such a problem also occurs when a framework member 110' having a T shape is press-formed by combining two L shapes as shown in FIG. 2.

In Patent Documents 1 to 4, bend-forming methods for manufacturing components having simple cross-sectional shapes such as a hat shape or a Z shape are described. However, such methods cannot be used for manufacturing the L-shaped component.

RELATED ART DOCUMENTS

Patent Documents

[Patent Document 1] Japanese Unexamined Patent Application, First Publication No. 2003-103306

[Patent Document 2] Japanese Unexamined Patent Application, First Publication No. 2004-154859

[Patent Document 3] Japanese Unexamined Patent Application, First Publication No. 2006-015404

[Patent Document 4] Japanese Unexamined Patent Application, First Publication No. 2008-307557

DISCLOSURE OF THE INVENTION

Problems to be Solved by the Invention

In consideration of the problem, an object of the present invention is to provide a press-forming method of a component with an L shape, the method being capable of press-forming a component with an L shape from a blank metal sheet with high yield even though a high-tensile material with low ductility and high strength is used for the blank metal sheet.

Means for Solving the Problems

In order to accomplish the object, the invention uses the following methods.

(1) A first aspect of the present invention is a forming method that forms a press component with an L shape from a blank metal sheet, the press component having a top sheet section and a vertical wall section which is connected to the top sheet section via a bent section having a part curved in an arc shape and which has a flange section on an opposite side to the bent section, the top sheet section being arranged on an outside of the arc of the vertical wall section, the method including: disposing the blank metal sheet between a die and both of a pad and a bending die; and forming the vertical wall section and the flange section while at least a part of the blank metal sheet is caused to slide on a part of the die corresponding to the top sheet section, the forming of the vertical wall section and the flange section being performed in a state where the pad is made close to or brought into contact with the blank metal sheet.

(2) In the forming method described in (1), in the forming of the vertical wall section and the flange section, a part of the metal sheet may be pressurized as an out-of-plane deformation suppressing area by the pad.

(3) In the forming method described in (1), in the forming of the vertical wall section and the flange section, a portion of the metal sheet that is made close to or brought into contact with an out-of-plane suppressing area of the pad as the out-of-plane deformation suppressing area may be formed in a state where a clearance between the pad and the die is equal to or larger than a thickness of the blank metal sheet and is maintained to be equal to or smaller than 1.1 times the thickness of the blank metal sheet.

(4) In the forming method described in (2) or (3), the out-of-plane deformation suppressing area may be, among areas of the top sheet section divided by a tangent line of a boundary line between the bent section and the top sheet section, the tangent line being defined at a first end portion which is one end portion of the part curved in the arc shape of the bent section when viewed in a direction perpendicular to a surface of the top sheet section, an area of the blank metal sheet which contacts with the part of the die corresponding to the top sheet section on a side including a second end portion which is other end portion of the part curved in the arc shape of the bent section.

(5) In the forming method described in any one of (2) to (4), in the end portion of the blank metal sheet, among portions of the part of the blank metal sheet corresponding to the out-of-plane deformation suppressing area, a portion which becomes the end portion of the part further on the top sheet side than the bent section may be on the same plane as that of the top sheet section.

(6) In the forming method described in any one of (1) to (5), the top sheet section may have an L shape, a T shape, or a Y shape.

(7) In the forming method described in any one of (1) to (6), a height of the vertical wall section may be equal to or larger than 0.2 times a length of the part curved in the arc shape of the bent section, or equal to or larger than 20 mm.

(8) In the forming method described in any one of (1) to (7), the forming of the vertical wall section and the flange section may be performed so that the pad is made close to or brought into contact with a region of the blank metal sheet; and the region of the blank metal sheet may be, among portions of the top sheet section, a portion which is in contact with a boundary line between the top sheet section and the part curved in the arc shape of the bent section, and which is within at least 5 mm from the boundary line.

(9) In the forming method described in any one of (4) to (8), in the flange section, in a portion of the vertical wall section connected to the part curved in the arc shape of the bent section, widths of a flange portion of the first end portion side from a center portion in a longitudinal direction of the flange of the portion connected to the opposite side to the top sheet section and a flange portion in front of the flange portion of the first end portion side by 50 mm or larger may be equal to or larger than 25 mm and equal to or smaller than 100 mm.

(10) In the forming method described in any one of (1) to (9), a radius of curvature of a maximum curvature portion of the boundary line between the part curved in the arc shape of the bent section and the top sheet section may be equal to or larger than 5 mm and equal to or smaller than 300 mm.

(11) In the forming method described in any one of (1) to (10), a pre-processed blank metal sheet may be press-formed as the blank metal sheet.

(12) In the forming method described in any one of (1) to (11), a blank metal sheet having a breaking strength of equal to or higher than 400 MPa and equal to or lower than 1,600 MPa may be used as the blank metal sheet.

(13) A second aspect of the present invention is a forming method of a press component having an L shape, including: performing forming by the forming method according to any one of items 1 to 12 to form a shape of a single L character, a shape of a plurality of L characters, or a shape of any L character, when a shape having a plurality of L characters is press-formed.

(14) A third aspect of the present invention is a forming method of a press component having an L shape, for forming an L shape which has a vertical wall section, a flange section connected to one end portion of the vertical wall section, and a top sheet section that is connected to an end portion of the vertical wall section on the opposite side to a side connected to the flange section and extends in the opposite direction to the flange section and in which a part or the entirety of the vertical wall section is curved so that the flange section is on the inside, by pressing a blank metal sheet, including: performing forming by disposing a blank metal sheet having a shape in which an end portion of a part of the blank metal sheet corresponding to a lower side of the L shape is inside the top sheet section, on a die, and pressing the vertical wall section and the flange section with a bending die while pressing the top sheet section with a pad.

(15) In the forming method described in (14), a width of the flange section on the upper side from the center of the curve of the vertical wall section may be equal to or larger than 25 mm and equal to or smaller than 100 mm.

(16) A fourth aspect of the present invention is a forming method of a press component having an L shape, for forming an L shape which has a vertical wall section, a flange section connected to one end portion of the vertical wall section, and a top sheet section that is connected to an end portion of the vertical wall section on the opposite side to a side connected to the flange section and extends in the opposite direction to the flange section and in which a part or the entirety of the vertical wall section is curved so that the flange section is on the inside, by pressing a blank metal sheet, including: disposing the blank metal sheet having a shape in which an end portion of a part of the blank metal sheet corresponding to the lower side of the L shape is inside the top sheet section, a margin thickness is provided in the flange section on the upper side from the center of the curve of the vertical wall section, and the sum of the thickness of the flange section and the margin thickness is equal to or larger than 25 mm and equal to or smaller than 100 mm, on a die; performing forming by pressing the vertical wall section and the flange section with a bending die while pressing the top sheet section with a pad; and trimming the margin thickness of the flange section.

(17) In the forming method described in (16), a radius of curvature of a maximum curvature portion of the curve of the vertical wall section may be equal to or larger than 5 mm and equal to or smaller than 300 mm.

(18) In the forming method described in (16) or (17), a pre-processed blank metal sheet may be press-formed as the blank metal sheet.

(19) In the forming method described in any one of (16) to (18), a steel sheet having a breaking strength of equal to or higher than 400 MPa and equal to or lower than 1,600 MPa may be used as the blank metal sheet.

(20) A fifth aspect of the present invention is a forming method of a press component having an L shape, including: performing forming by the forming method according to any one of items 16 to 19 to form a shape of a single L character, a shape of a plurality of L characters, or a shape of any L character, when a shape having a plurality of L characters is press-formed.

Effects of the Invention

According to the invention, when the component with the L shape (L-shaped component) is press-formed from the blank metal sheet, a part of the blank metal sheet corresponding to the lower side portion of the L shape of the L-shaped component is drawn toward the vertical wall section. As a result, in the flange section in which cracks are more likely to be generated due to a reduction in the thickness of the sheet during typical drawing, excessive drawing of the member is reduced, so that generation of cracks is suppressed. In addition, in the top sheet section in which wrinkles are more likely to be generated due to an inflow of an excessive metal material during typical drawing, the member is drawn, so that generation of wrinkles is suppressed.

In addition, since a large trim area for blank holding does not need to be provided in the part of the blank metal sheet corresponding to the lower side portion of the L shape of the L-shaped component, unlike a typical forming method, the area of the blank metal sheet can be reduced, thereby increasing the yield. Moreover, since ductility needed by the blank metal sheet for forming is reduced, in addition to a steel sheet which has excellent ductility and relatively low strength and is thus typically used, a steel sheet having relatively low ductility and high strength can be used as the blank metal sheet. Accordingly, the thickness of the blank metal sheet can be reduced, thereby contributing to a reduction in weight of the automobile.

DETAILED DESCRIPTION OF THE INVENTION

Figure 1:
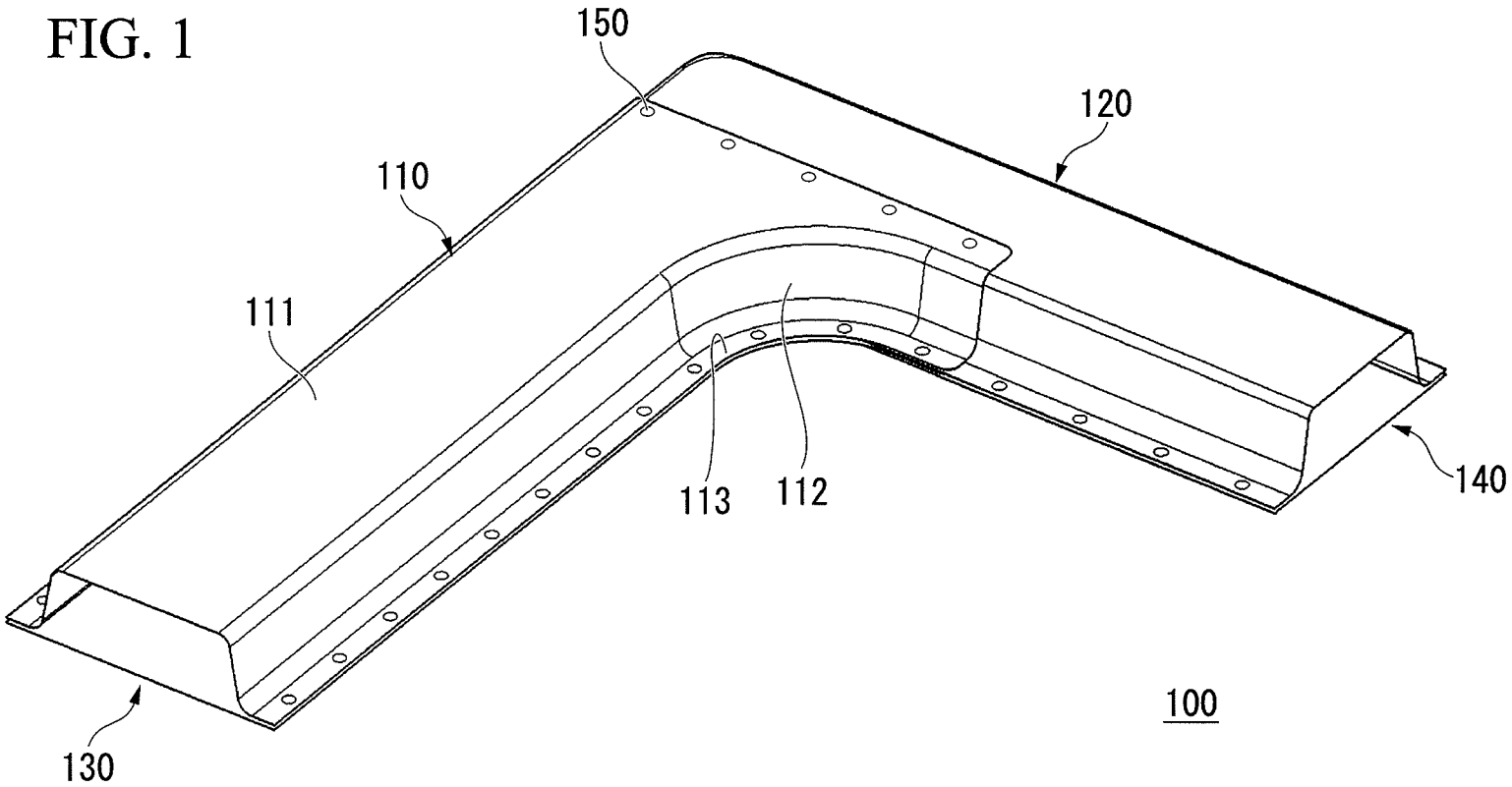
FIG. 1 is a perspective view showing a framework structure 100 including a framework member 110 having an L shape.
Figure 2:
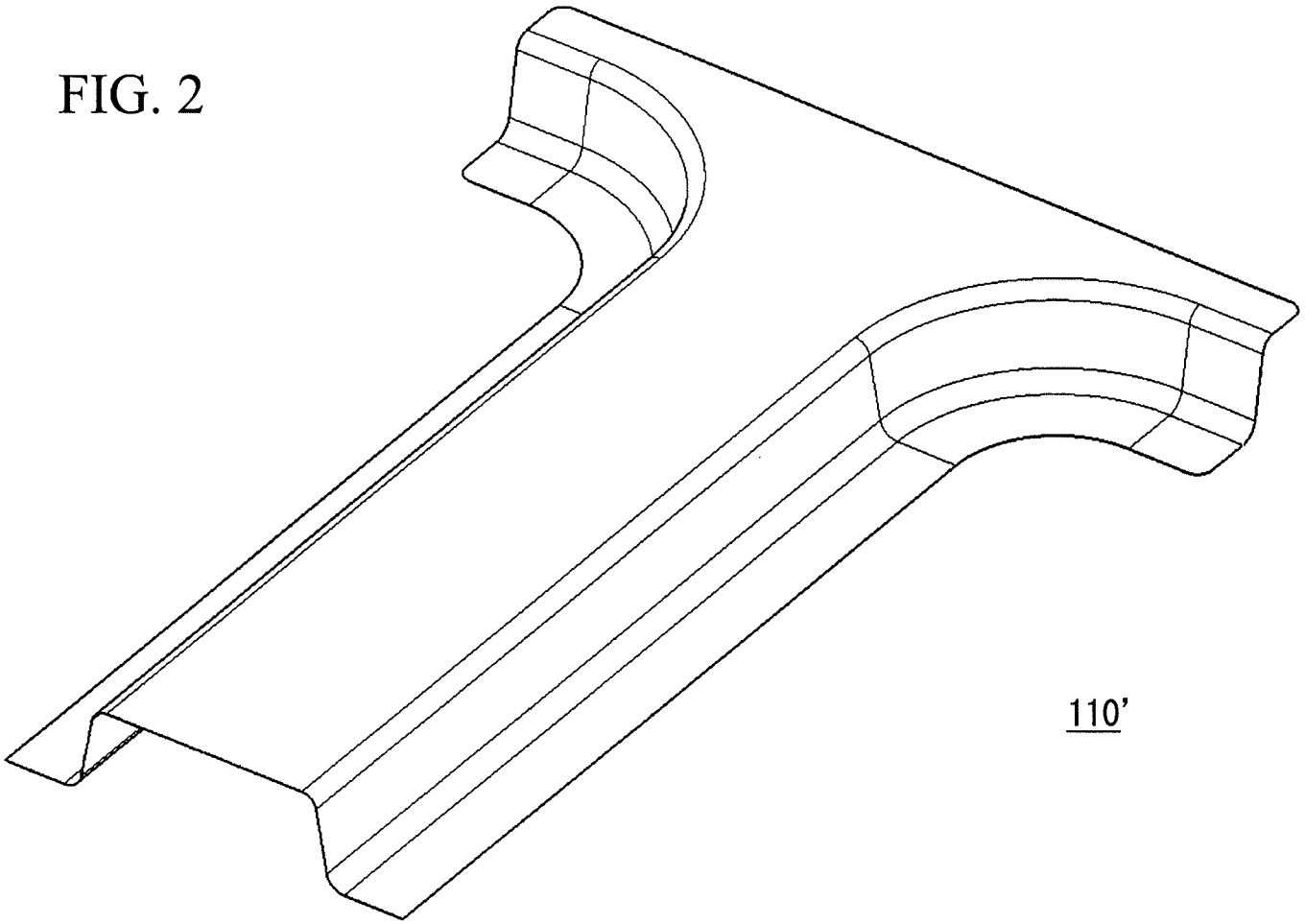
FIG. 2 is a perspective view showing a framework member 110' having a T shape.
Figure 3:
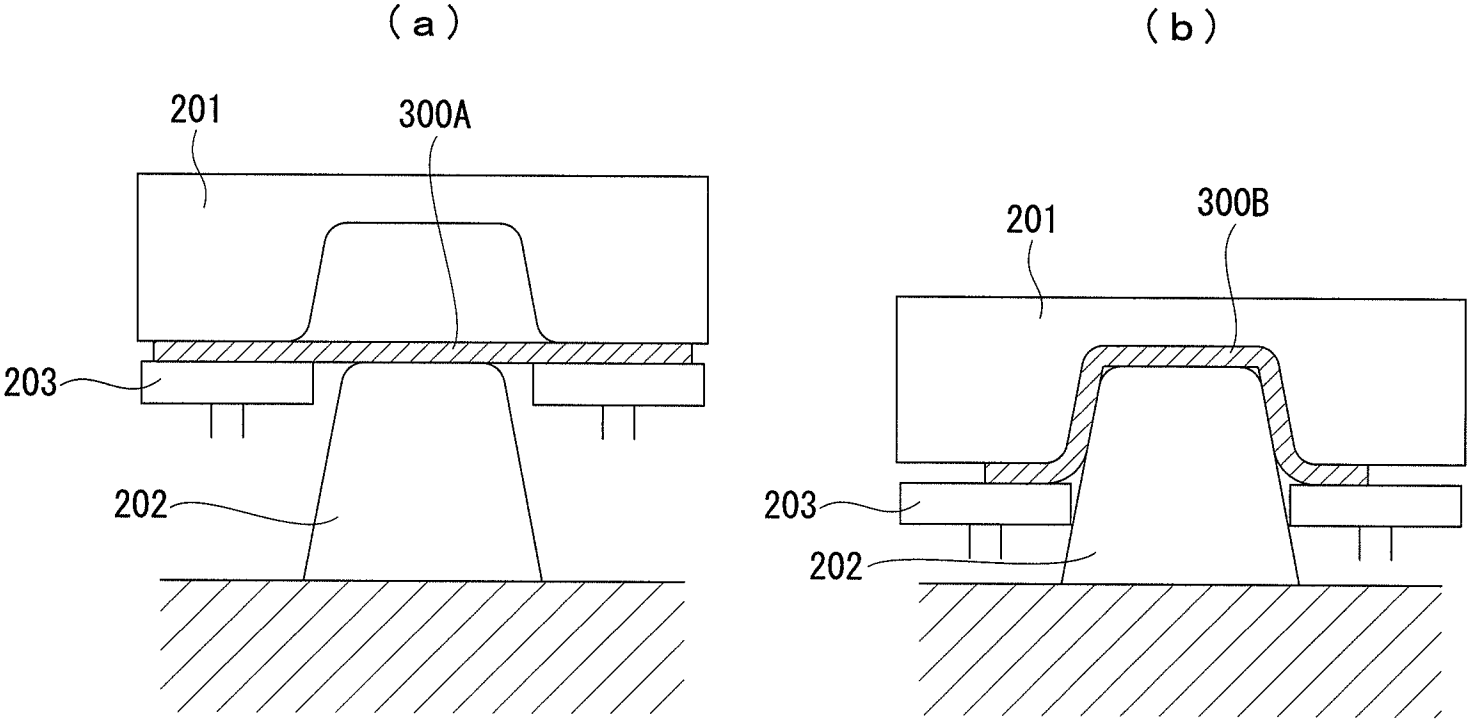
FIG. 3 is an explanatory view of a drawing method.
Figure 4A:
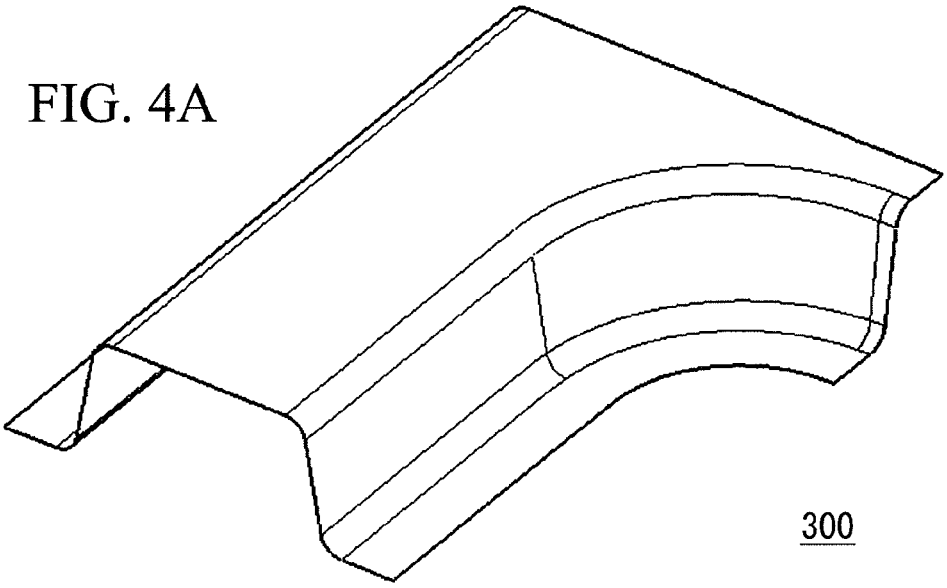
FIG. 4A is a perspective view showing a component 300 obtained by the drawing method.
Figure 4B:
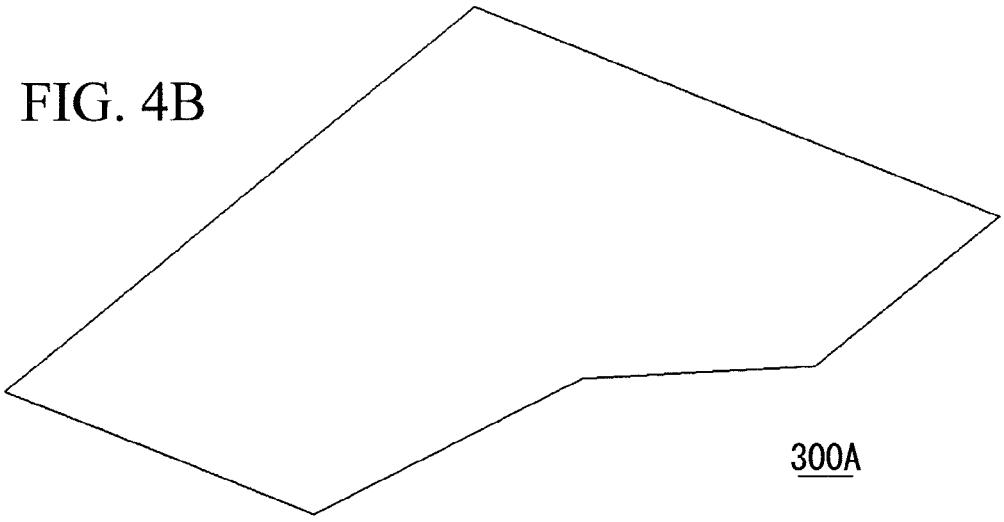
FIG. 4B is a perspective view showing a blank metal sheet 300A which is to be formed into the component 300.
Figure 4C:
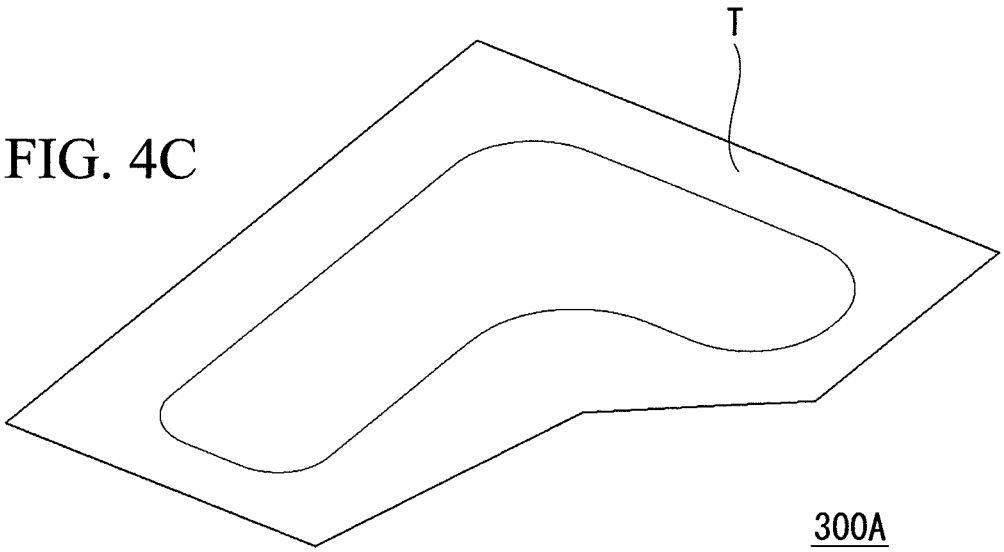
FIG. 4C is a perspective view showing a clamped area T in the periphery of the blank metal sheet 300A.
Figure 4D:
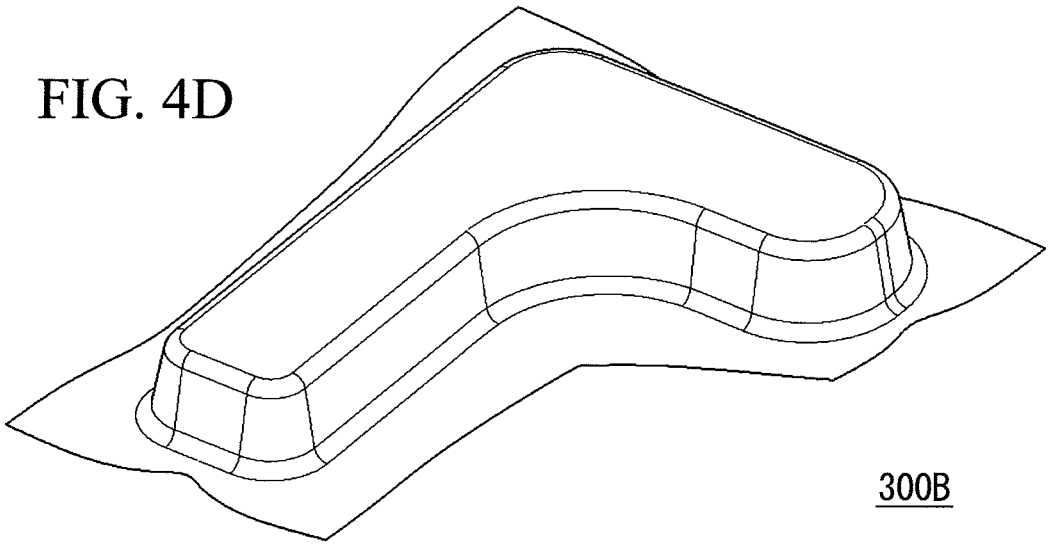
FIG. 4D is a perspective view showing a formed body 300B obtained by drawing the blank metal sheet 300A.
Figure 5:
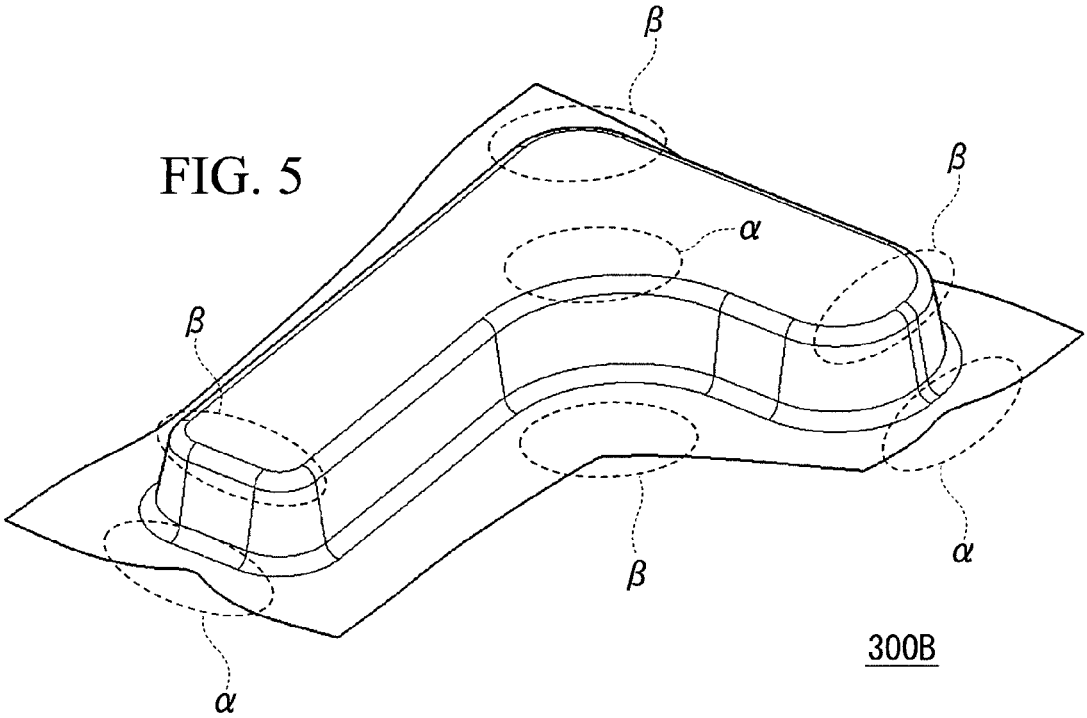
FIG. 5 is a perspective view showing α portions in which wrinkles are more likely to be generated and β portions in which cracks are more likely to be generated in the formed body 300B.

Hereinafter, a press-forming method according to an embodiment of the invention will be described in detail.

In the press-forming method according to this embodiment, a component having a top sheet section 11 and a vertical wall section 12 which is connected to the top sheet section 11 with a bent section 15 having a part 15*a* curved in an arc shape and has a flange section 13 on the opposite side to the bent section 15, is formed from a steel sheet (a blank metal sheet). The top sheet section 11 exists on the outside of the arc of the vertical wall section 12. In this press-forming method, the vertical wall section 12 and the flange section 13 are formed while at least a part of the area of the steel sheet S (at least a part of the area of the steel sheet S corresponding to the top sheet section 11) is allowed to slide (in-plane movement) on a part of a die 51 corresponding to the top sheet section 11. More specifically, the steel sheet S is disposed between the die 51 and both of a pad 52 and a bending die 53, and in a state where the pad 52 is made close to or brought into contact with the steel sheet S, the vertical wall section 12 and the flange section 13 are formed while at least a part of the steel sheet S is caused to slide on the part of the die 51 corresponding to the top sheet section 11.

In addition, "a state where the pad is made close to the steel sheet" means a state where the steel sheet and the pad do not come in contact with each other when the steel sheet slides on the part of the die corresponding to the top sheet section, and the steel sheet and the pad come in contact with each other when the steel sheet is likely to undergo out-of-plane deformation (or buckling) on the corresponding part.

During forming of the vertical wall section 12 and the flange section 13, a part of a metal sheet S may be pressurized as an out-of-plane deformation suppressing area (area F) at a predetermined load pressure by the pad 52.

For example, when a pad load pressure is set to be high and thus "the portion that abuts on the top of the die 51" of the steel sheet S cannot sufficiently slide (perform in-plane movement) between the die 51 and the pad 52 during pressing, cracks are generated in the flange section 13.

In addition, when the load pressure by the pad 52 is set to be low and thus out-of-plane deformation of "the portion that abuts on the top of the die 51" of the steel sheet S cannot be restrained during pressing, wrinkles are generated in the top sheet section 11.

When a metal sheet which is generally used for automobile components and the like and has a tensile strength of 200 MPa to 1,600 MPa is formed, when the metal sheet is pressured at a pressure of equal to or higher than 30 MPa, cracks are generated in the flange section 13. On the other hand, when the metal sheet is pressurized at a pressure of equal to or lower than 0.1 MPa, out-of-plane deformation of the top sheet section 11 cannot be sufficiently suppressed. Therefore, it is preferable that pressurizing by the pad 52 be performed at a pressure of equal to or higher than 0.1 MPa and equal to or lower than 30 MPa.

Moreover, in consideration of a pressing machine or a die unit for manufacturing general automobile components, since a load is low at a pressure of equal to or lower than 0.4 MPa, it is difficult to stably pressurize the pad 52 using a cushion gas. In addition, at a pressure of equal to or larger than 15 MPa, a high-pressure pressurizing apparatus is needed, and thus equipment costs are increased. Therefore, it is more preferable that pressurizing by the pad 52 be performed at a pressure of equal to or higher than 0.4 MPa and equal to or lower than 15 MPa.

The pressure mentioned herein is an average surface pressure obtained by dividing a pad pressurizing force by the area of the contact portion of the pad 52 and the steel sheet S, and may be slightly locally uneven.

In addition, during forming of the vertical wall section 12 and the flange section 13, the forming may be performed in a state where, as an out-of-plane deformation suppressing area (the area F), a portion of the steel sheet S that is made close to or brought into contact with an out-of-plane deformation suppressing area of a pad maintains a clearance between the pad 52 and the die 51. Here, the clearance may be equal to or larger than the thickness of the steel sheet S and equal to or smaller than 1.1 times the thickness of the steel sheet S.

For example, when the portion corresponding to the top sheet section 11 is formed in the state where the clearance between the pad 52 and the die 51 is equal to or larger than the thickness of the steel sheet S and is maintained to be equal to or smaller than 1.1 times the thickness thereof, the steel sheet S can sufficiently slide (perform in-plane movement) in the die unit 50 since an excessive surface pressure is not applied to the sheet S. Moreover, when a surplus thickness is provided in the top sheet section 11 as the forming proceeds and thus a force to cause the steel sheet S to undergo out-of-plane deformation is exerted, out-of-plane deformation of the steel sheet S is restrained by the pad 52, so that generation of cracks or wrinkles can be suppressed.

When the portion corresponding to the top sheet section 11 is formed by setting the clearance between the pad 52 and the die 51 to be smaller than the thickness of the steel sheet S, an excessive surface pressure is exerted between the steel sheet S and the die 51, and thus the steel sheet S cannot sufficiently slide (perform in-plane movement) in the die unit 50 and cracks are generated in the flange section 13.

On the other hand, when the portion corresponding to the top sheet section 11 is formed by setting the clearance between the pad 52 and the die 51 to be equal to or larger than 1.1 times the thickness of the steel sheet S, out-of-plane deformation of the steel sheet S cannot be sufficiently strained during pressing, so that the steel sheet S is significantly left at the top sheet section 11 as the forming proceeds. Therefore, in addition to the generation of significant wrinkles, buckling occurs in the top sheet section 11, so that the portion cannot be formed into a predetermined shape.

With regard to a portion of the metal sheet which is generally used for automobile components and the like and has a tensile strength of 200 MPa to 1,600 MPa, the portion being close to or brought into in contact with the out-of-plane suppressing area of the pad 52 as the out-of-plane deformation suppressing area (the area F), when the portion is formed in the state where the clearance between the pad 52 and the die 51 is equal to or larger than the thickness of the sheet and is maintained to be equal to or smaller than 1.1 times the thickness of the sheet, small wrinkles are generated if the clearance between the pad 52 and the die 51 is equal to or larger than 1.03 times the thickness of the sheet. Therefore, it is more preferable that the clearance between the pad 52 and the die 51 be equal to or larger than the thickness of the sheet and equal to or smaller than 1.03 times the thickness of the sheet.

Figure 8:
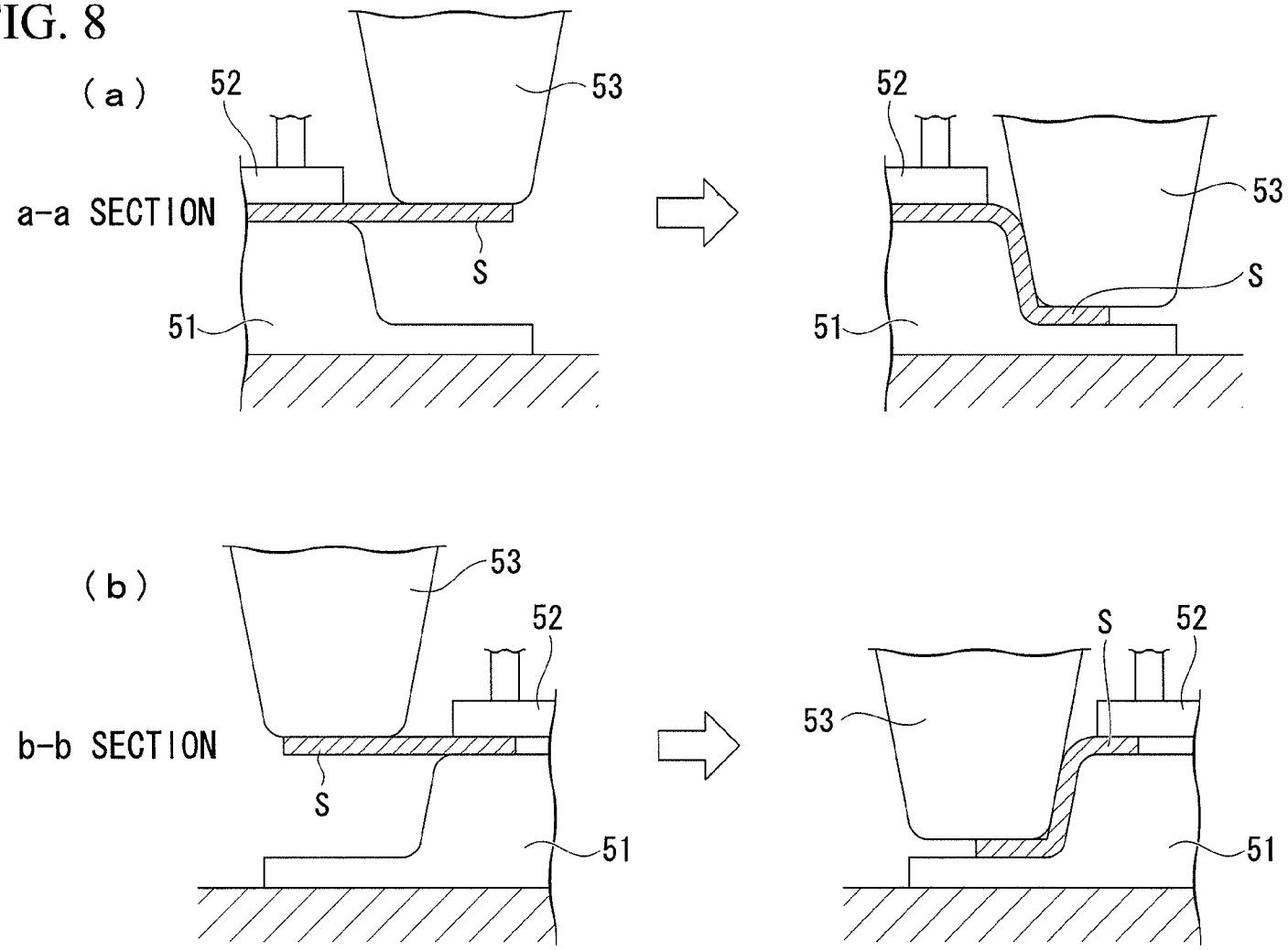
FIG. 8 is a schematic view showing a press forming process performed by the die unit 50 used in the press component forming method according to the embodiment of the invention.

Specifically, in the press-forming method according to this embodiment, as shown in (*a*) and (*b*) of FIG. 8, when a steel sheet S is pressed to be formed into an L shape which has the vertical wall section 12, the flange section 13 connected to the vertical wall 12 with the one end portion, and the top sheet section 11 connected to an end portion of the vertical wall section 12 on the opposite side to the side connected to the flange section 13 and extends in the opposite direction to the flange section 13, and which is curved so that a part or the entirety of the vertical wall becomes the inside of the flange section 13, the steel sheet S having a shape in which an end portion of a part of the steel sheet S corresponding to the lower side of the L shape of the steel sheet S is inside the top sheet section 11 is disposed on a die 51, and the vertical wall section 12 and the flange section 13 are pressed by the bending die 53 while pressing the top sheet section 11 with the pad 52 or causing the top sheet section 11 to come close to the pad 52. In FIG. 8, (*a*) shows the behavior of the steel sheet S along the arrow a-a of FIG. 6 during pressing, and FIG. 8B shows the behavior of the steel sheet S along the arrow b-b of FIG. 6 during pressing.

Figure 6:
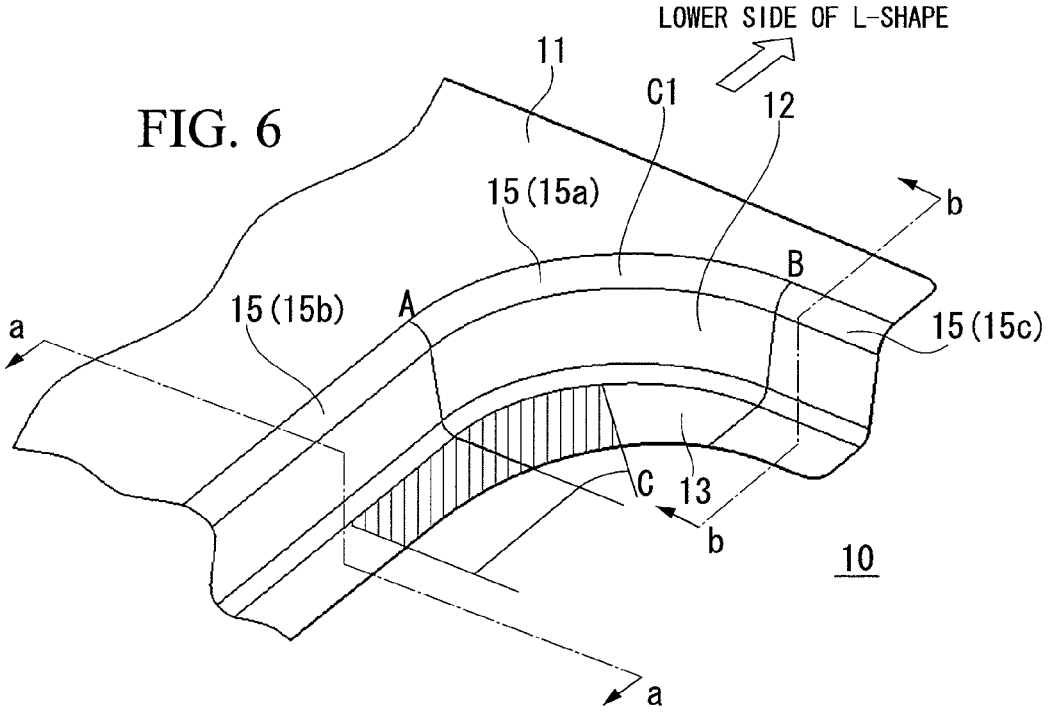
FIG. 6 is a perspective view of an L-shaped component 10 obtained by a press component forming method according to an embodiment of the invention.

An L-shaped component 10 has the planar top sheet section 11 having an L shape, the vertical wall section 12, and the flange section 13 as shown in FIG. 6. The top sheet section 11 is connected to the vertical wall section 12 with the bent section 15 including the part 15*a* curved in the arc. The arc of the part 15*a* curved in the arc shape has a shape having a predetermined curvature, an elliptical shape, a shape having a plurality of curvatures, a shape having a straight portion, or the like as viewed in the press direction. That is, in the L-shaped component 10, the top sheet section 11 exists on the outside of the arc of the part 15*a* curved in the arc shape, and the flange section 13 exists on the inside of the arc (on the center point side of the arc) of the part 15*a* curved in the arc shape. In addition, the top sheet section 11 does not need to be completely planar, and may have various additional shapes on the basis of the design of a press product.

According to the invention, as shown in FIG. 6, from both end portions of the part 15*a* curved in the arc shape in the L-shaped component 10, the end portion at a position distant from the end portion (the end portion of the lower side of the L shape) of the bent section 15 is referred to as an end portion A (first end portion), and the end portion at a position close to the end portion (the end portion of the lower side of the L shape) of the bent section 15 is referred to as an end portion B (second end portion). The bent section 15 has a part 15*b* extending substantially in a straight shape from the outside of the end portion A (the opposite side to the end portion B), and a part 15*c* extending substantially in a straight shape from the outside of the end portion B (the opposite side of the end portion A). Here, there may be a case where the end portion B of the part 15*a* curved in the arc shape is the same as an end portion of the bent section 15. In this case, the part 15*c* extending substantially in the straight shape from the outside of the end portion B (the opposite side of the end portion A) does not exist.

The steel sheet S has a shape from which the L-shaped component 10 is developed. That is, the steel sheet S has parts corresponding to the top sheet section 11, the vertical wall section 12, the flange section 13, and the like in the L-shaped component 10.

As the steel sheet S (the blank metal sheet), a pre-processed steel sheet (blank metal sheet) which is subjected to pre-processing such as press-forming, bend-forming, or perforating may also be used.

During forming of the vertical wall section 12 and the flange section 13, it is preferable that, in the end portion A (first end portion) which is one end portion of the part 15*a* curved in the arc shape of the bent section 15 when viewed in a direction perpendicular to a surface of the top sheet section 11 (press direction), among portions of an area of the top sheet section 11 divided by a tangent line of a boundary line between the bent section 15 and the top sheet section 11, an area (a hatched portion of FIG. 10) which contacts with the top sheet surface of the die 51 (a surface corresponding to the top sheet section of the steel sheet S) in an area of a side including the end portion B (second end portion) which is the other end portion of the part 15*a* curved in the arc shape of the bent section 15 be pressurized as an out-of-plane deformation suppressing area (area F). In this case, generation of wrinkles of the top sheet section 11 or the vertical wall section 12 can be suppressed. During pad pressurization, it is preferable that a pad having a shape that can cover the entire surface of the part of the steel sheet S that contacts with the top sheet surface of the die 51 to a part of the steel sheet S that contacts with the top sheet surface of the die 51 while including the entire out-of-plane deformation suppressing area (the area F) be used. However, for example, when an additional shape exists in the out-of-plane deformation suppressing area (the area F) due to the design of a product, in order to avoid the additional shape, a pad having a shape that can cover an area of at least from a part of the out-of-plane deformation suppressing area (the area F) which contacts with a boundary line with the part of the bent section curved in the arc shape, an area within 5 mm from the boundary line, and to cover an area of 50% or larger of the out-of-plane deformation suppressing area (the area F) may be used. Moreover, a pad in which pressurizing surfaces arc separated may be used.

In addition, it is preferable that, in the steel sheet S, in a part of the top sheet section 11, which abuts on a boundary line between the top sheet section 11 and the part 15*a* curved in the arc shape of the bent section 15, an area within at least 5 mm from the boundary line be pressurized by the pad 52. On the other hand, for example, when only an area within 4 mm from the boundary line is pressurized by the pad 52, wrinkles are more likely to be generated in the top sheet section 11. Here, the generation of wrinkles does not have a significant effect on product strength compared to the generation of cracks.

Figure 7:
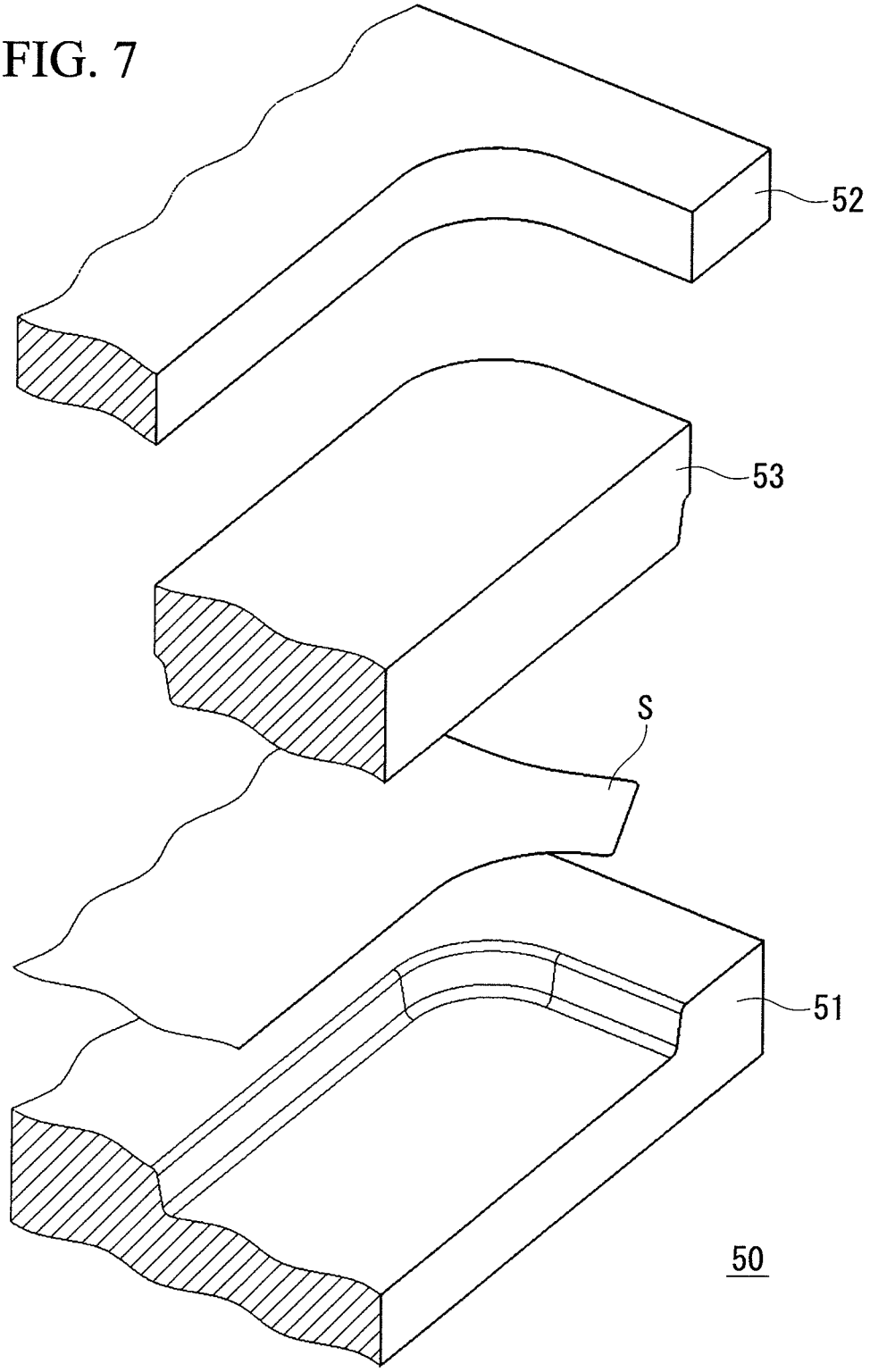
FIG. 7 is a schematic diagram of a die unit 50 used for the press component forming method according to the embodiment of the invention.

In FIG. 7, the die unit 50 used in the press-forming method according to this embodiment is shown. The die unit 50 includes the die 51, the pad 52, and the bending die 53.

A driving mechanism of the pad 52 used to pressurize the steel sheet S so that in-plane movement can be allowed in the part corresponding to the out-of-plane deformation suppressing area (the area F) may be a spring or a hydraulic pressure, and a cushion gas may be used as the pad 52.

In addition, with regard to part that approaches or comes in contact with the out-of-plane deformation suppressing area (the area F), a driving mechanism of the pad 52 used to form the vertical wall section 12 and the flange section 13 in a state where a clearance of the pad 52 and the die 51 is maintained to be equal to or larger than the thickness of the steel sheet S and to be equal to or smaller than 1.1 times the thickness thereof may be a motor cylinder, a hydraulic servo apparatus, or the like.

Figure 9A:
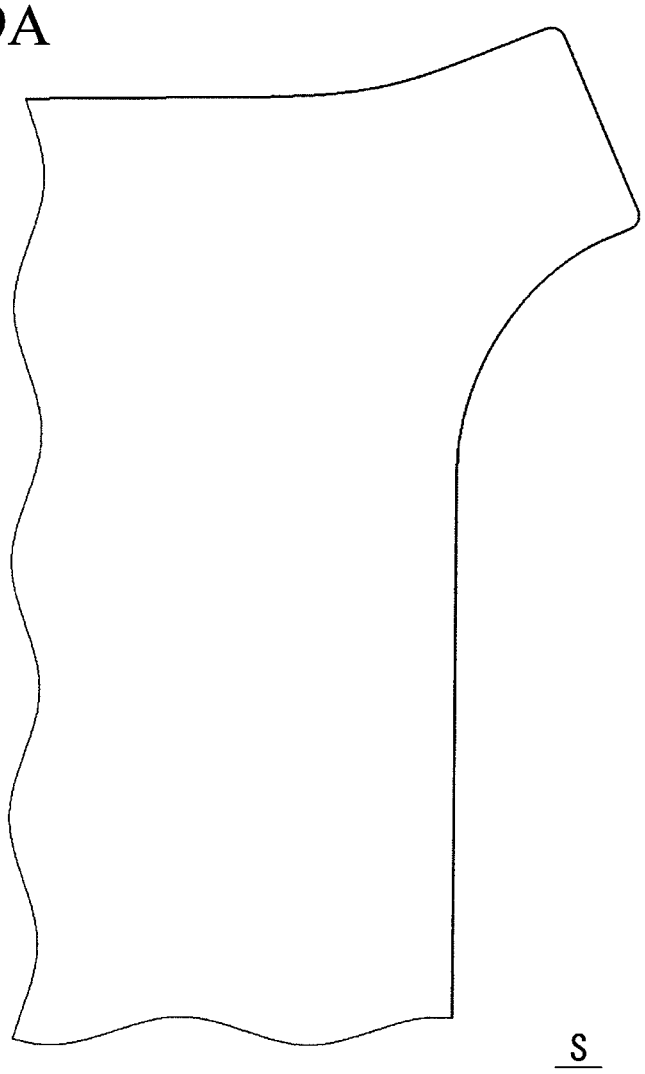
FIG. 9A is a diagram showing a steel sheet S used in the press component forming method according to the embodiment of the invention.
Figure 9B:
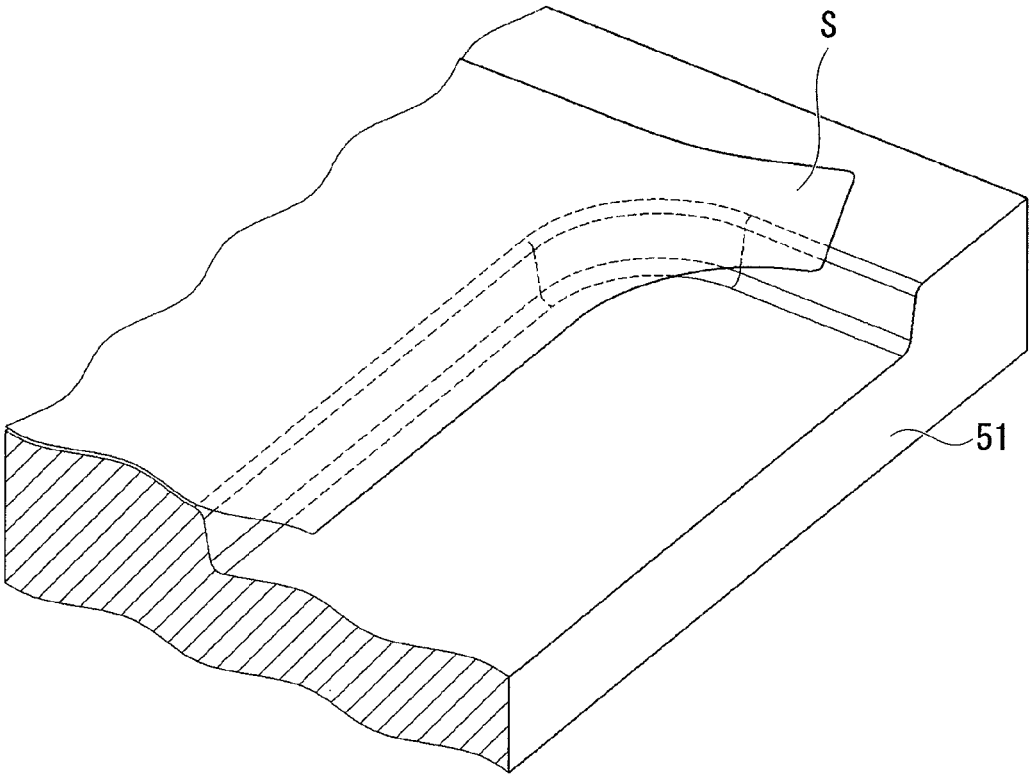
FIG. 9B is a perspective view showing a state where the steel sheet S is disposed on a die 51.
Figure 9C:
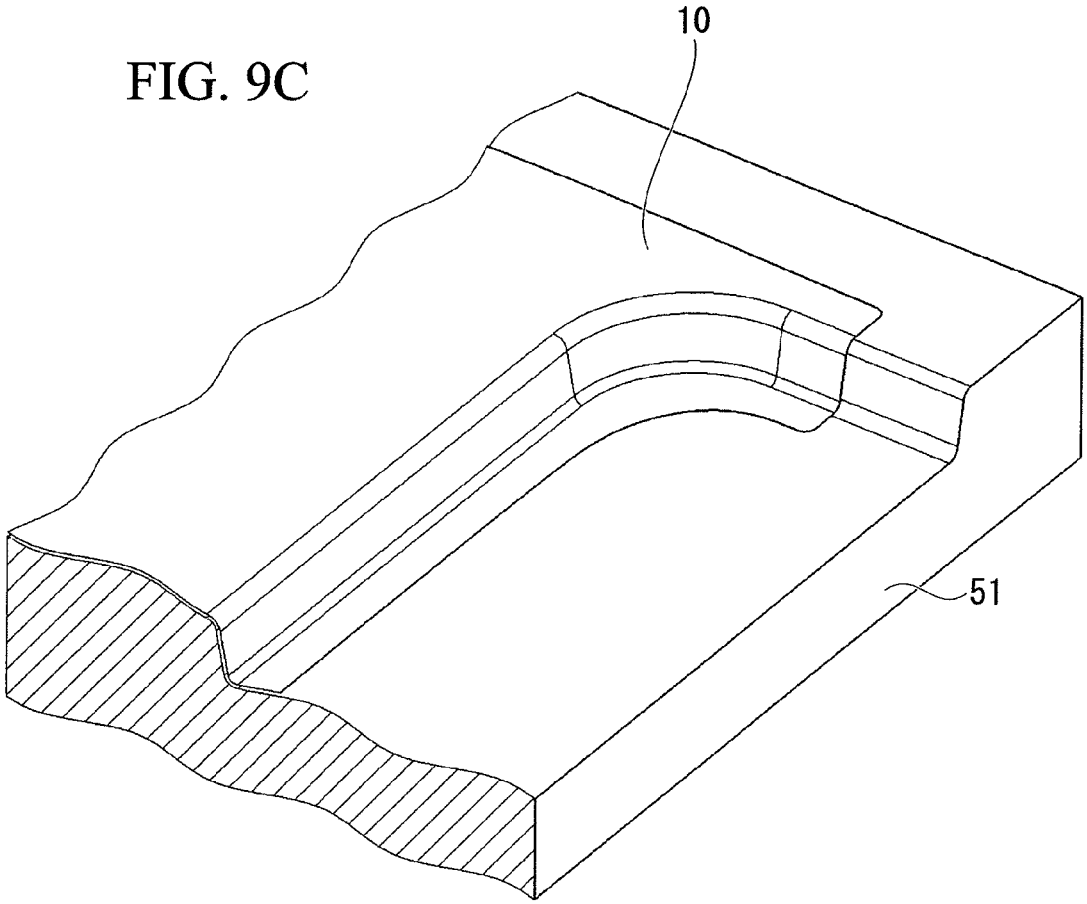
FIG. 9C is a perspective view showing a state where the steel sheet S is formed into the L-shaped component 10.

In the press-forming method according to this embodiment, the steel sheet S having a shape from which a formed body is developed, which is shown in FIG. 9A, is installed on the die 51 as shown in FIG. 9B. In addition, in the state where the part corresponding to the top sheet section 11 of the L-shaped component 10 is pressurized against the die 51 by the pad 52, the bending die 53 is lowered in the press direction P, such that the vertical wall section 12 and the flange section 13 are formed as shown in FIG. 9C.

As described above, as the bending die 53 is lowered in the press direction, the steel sheet S is deformed along the shapes of the vertical wall section 12 and the flange section 13. Here, in the steel sheet S, the part corresponding to the vertical wall section 12 of the lower side portion of the L shape flows into the vertical wall section 12. That is, since the position in the steel sheet S corresponding to the top sheet section 11 of the lower side portion of the L shape is stretched, generation of wrinkles in the top sheet section 11, in which wrinkles are more likely to be generated due to an inflow of an excessive metal material during typical drawing, is suppressed. In addition, since the position in the steel sheet S corresponding to the flange section 13 of the lower side portion of the L shape is not excessively stretched, generation of cracks in the flange section 13, in which cracks are more likely to be generated due to a reduction in the thickness of the sheet during typical drawing, is suppressed. As the generation of wrinkles and cracks is suppressed as described above, a large trim area for blank holding does not need to be provided in the part of the steel sheet S corresponding to the lower side portion of the L shape of the L-shaped component, unlike a typical forming method.

Figure 10:
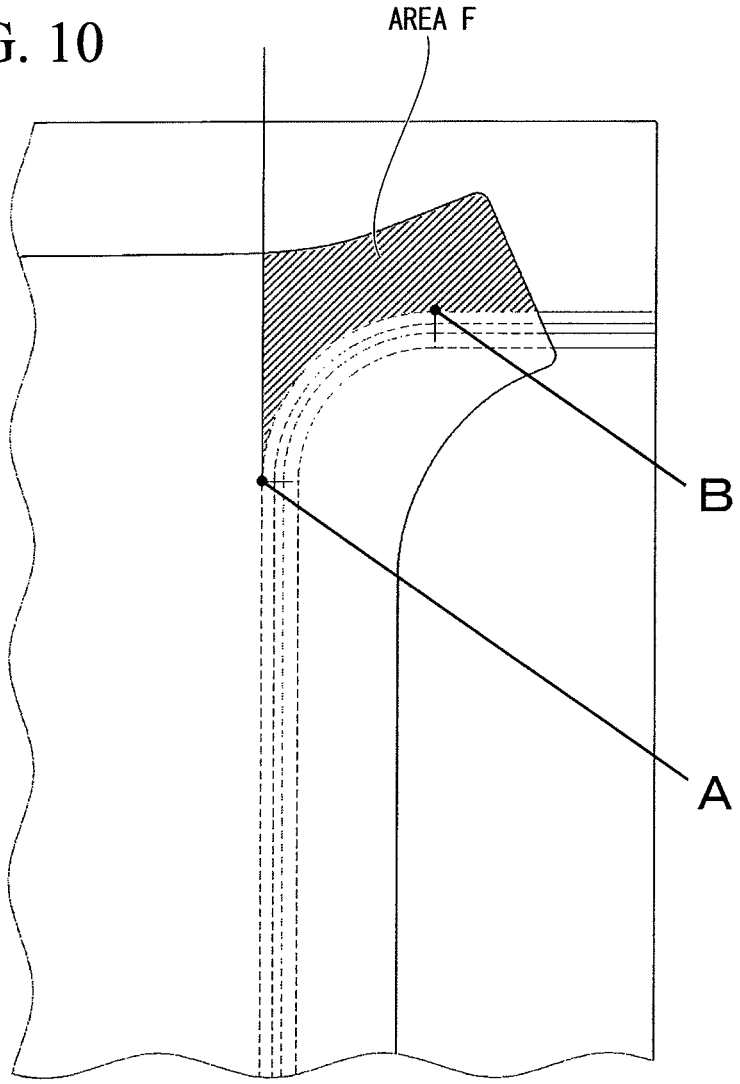
FIG. 10 is a diagram showing an out-of-plane deformation suppressing area (area F) of the steel sheet S as a hatched section.

The shape of the steel sheet S may be a shape in which an end portion of at least a part thereof is on the same plane as the top sheet section 11 (a shape in which the end portion is not wound during press-forming). That is, as shown in FIG. 10, it is preferable that the end portion of the part corresponding to the out-of-plane deformation suppressing area (the area F) in the steel sheet S be on the same plane as the top sheet section 11.

If the height H of the vertical wall section 12 to be formed is smaller than 0.2 times the length of the part 15*a* curved in the arc shape of the bent section 15 or smaller than 20 mm, wrinkles are more likely to be generated in the vertical wall section 12. Therefore, it is preferable that the height H of the vertical wall section 12 be equal to or larger than 0.2 times the length of the part 15*a* curved in the arc shape of the bent section 15 or equal to or larger than 20 mm.

In addition, since a reduction in the thickness of the sheet due to forming is suppressed, in addition to a steel sheet having high ductility and relatively low strength (for example, a steel sheet having a breaking strength of about 1,600 MPa), even a steel sheet having low ductility and relatively high strength (for example, a steel sheet having a breaking strength of about 400 MPa) can be properly press-formed. Therefore, as the steel sheet S, a high-strength steel sheet having a breaking strength of equal to or higher than 400 MPa and equal to or lower than 1,600 MPa may be used.

Moreover, in the press-forming method according to this embodiment, the width $h_t$ of the flange section 13 on the upper side from the center of the curve of the vertical wall may be equal to or larger than 25 mm and equal to or smaller than 100 mm. More specifically, it is preferable that the press-forming be performed so that in the flange section 13, in a portion of the vertical wall section 12 connected to the part 15*a* curved in the arc shape of the bent section 15, the widths $h_t$ of a flange portion 13*a* of the end portion A side from a center line C in a longitudinal direction (peripheral direction) of the flange section 13 of the portion connected to the opposite side to the top sheet section 11 and a flange portion 13*b* (that is, an area O) in front of the flange portion of the end portion A side by 50 mm are equal to or larger than 25 mm and equal to or smaller than 100 mm.

The width $h_t$ is defined as a shortest distance from an arbitrary position in the flange end portions of the flange portions 13*a* and 13*b*, to a position on the boundary line between the vertical wall section and the flange section.

When points of which the widths $h_t$ are smaller than 25 mm exist in the flange portions 13*a* and 13*b*, a reduction in the thickness of the flange section is increased, and therefore cracks are more likely to be generated. This is because a force to draw the front end portion of the lower side portion of the L shape into the vertical wall section 12 during forming is concentrated on the vicinity of the flange section.

When points of which the widths $h_t$ are larger than 100 mm exist in the flange portions 13*a* and 13*b*, an amount of the flange section 13 compressed is increased, and therefore wrinkles are more likely to be generated.

Therefore, by causing the width $h_t$ to be equal to and larger than 25 mm and equal to and smaller than 100 mm, generation of wrinkles and cracks in the flange section 13 can be suppressed.

Accordingly, when a component having a shape in which the width $h_t$ of the flange section on the inside of the L shape is smaller than 25 mm is manufactured, it is preferable that after press-forming the L shape having the flange section of which the width is equal to or larger than 25 mm, unnecessary portions be trimmed.

Furthermore, a radius of curvature of a maximum curvature portion of the curve of the vertical wall section 12, that is, a radius (RMAX) of curvature of a maximum curvature portion of the boundary line between the part 15*a* curved in the arc shape of the bent section 15 and the top sheet section 11, be equal to or larger than 5 mm and equal to or smaller than 300 mm.

When the radius of curvature of the maximum curvature portion is smaller than 5 mm, the periphery of the maximum curvature portion is locally pulled outward, and therefore cracks are more likely to be generated.

When the radius of curvature of the maximum curvature portion is larger than 300 mm, the length of the front end of the lower portion of the L shape is lengthened and thus the distance drawn into the inside (the vertical wall section 12) of the L shape is increased during press-forming, so that a sliding distance between the die unit 50 and the steel sheet S is increased. Therefore, wear of the die unit is accelerated, resulting in a reduction in the life-span of the die. It is more preferable that the radius of curvature of the maximum curvature portion be smaller than 100 mm.

In the above-described embodiment, the forming method of a member having a single L shape is exemplified. However, the invention can also be applied to forming of a component having a shape of two L characters (a T-shaped component and the like), or a component having a shape of two or more L characters (a Y-shaped component and the like). That is, when a shape having a plurality of L characters is to be press-formed, forming may be performed by the forming method of the L shape described above to form a shape of a single L character, a plurality of L characters, or any L character. In addition, the top sheet section 11 may have an L shape, a T shape, or a Y shape. Moreover, the top sheet section 11 may have a T shape or Y shape which is left-right asymmetric.

In addition, a vertical positional relationship between the die 51 and the bending die 53 is not limited to that of the invention.

Moreover, the blank metal sheet according to the invention is not limited only to the steel sheet S. For example, blank metal sheets suitable for press-forming, such as, an aluminum sheet or a Cu—Al alloy sheet may also be used.

EXAMPLES

In Examples 1 to 52, formed bodies each of which has a top sheet section, a vertical wall section, and a flange section were formed using a die unit having a pad mechanism. Perspective views ((a) in the figures) of the formed bodies formed in Examples 1 to 52, and plan views of an area O (an area of (arc length)/2 mm+50 mm), an area F (an out-of-plane deformation suppressing area), and a pressurized position which was actually pressurized and is shown as hatched sections ((b), (c), and (d) in the figures) are shown in FIGS. 11 to 32. The unit of dimensions indicated in FIGS. 11 to 32 is mm. In addition, the end portion A (the first end portion) and the end portion B (the second end portion) of the formed body which is press-formed in each example are shown as A and B in the figures, respectively.

In Tables 1A and 1B, figures corresponding to the respective examples are indicated, and with regard to the material of the blank metal sheet used in each example, "blank metal sheet type", "sheet thickness (mm)", and "breaking strength (MPa)" are shown.

In Tables 2A and 2B, with regard to the shape of the formed body formed in each example, "top sheet shape", "arc length (mm)", "arc length×0.2", "radius of curvature of maximum curvature portion of arc", "height H of vertical wall section", "A end flange width (mm)", "shape of arc", "winding of end portion", "shape of front of A end", and "additional shape of top sheet section" are shown.

In Tables 3A and 3B, with regard to the forming condition, "pressurized position", "pressurized range from boundary line (mm)", "pre-processing", "forming load (ton)", "pad load pressure (MPa)", and "ratio of clearance between pad and die to sheet thickness (clearance between pad and die/sheet thickness)" are shown.

In Tables 4A and 4B, results of "wrinkle evaluation of flange section", "crack evaluation of flange section", "wrinkle evaluation of top sheet section", "crack evaluation of top sheet section", and "wrinkle evaluation of vertical wall section" are shown.

In the wrinkle evaluations of the flange section, the top sheet section, and the vertical wall section, a case where no wrinkle was observed by visual inspection was evaluated as A, a case where small wrinkles were observed was evaluated as B, a case where wrinkles were observed was evaluated as C, a case where significant wrinkles were observed was evaluated as D, and a case where buckling deformation was observed was evaluated as X. In addition, in the crack evaluations of the flange section and the top sheet section, a case where no crack was generated was evaluated as O, a case where necking (a portion where the sheet thickness is locally reduced by 30% or higher) was generated was evaluated as Δ, and a case where cracks were generated was evaluated as X.

TABLE 1A

Figure 11:
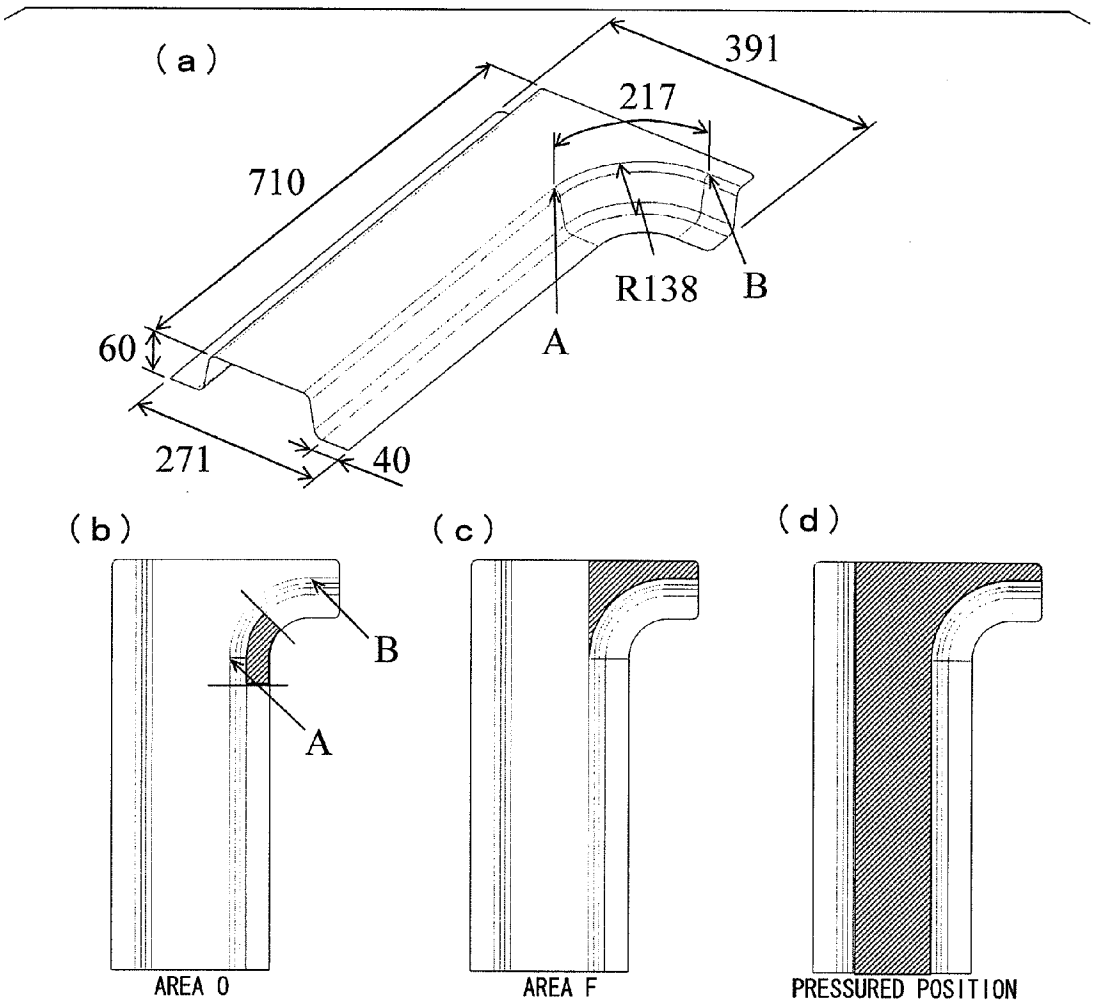
FIG. 11 is a diagram for explaining formed bodies in Examples 1 to 3 and 41 to 52.
Figure 12:
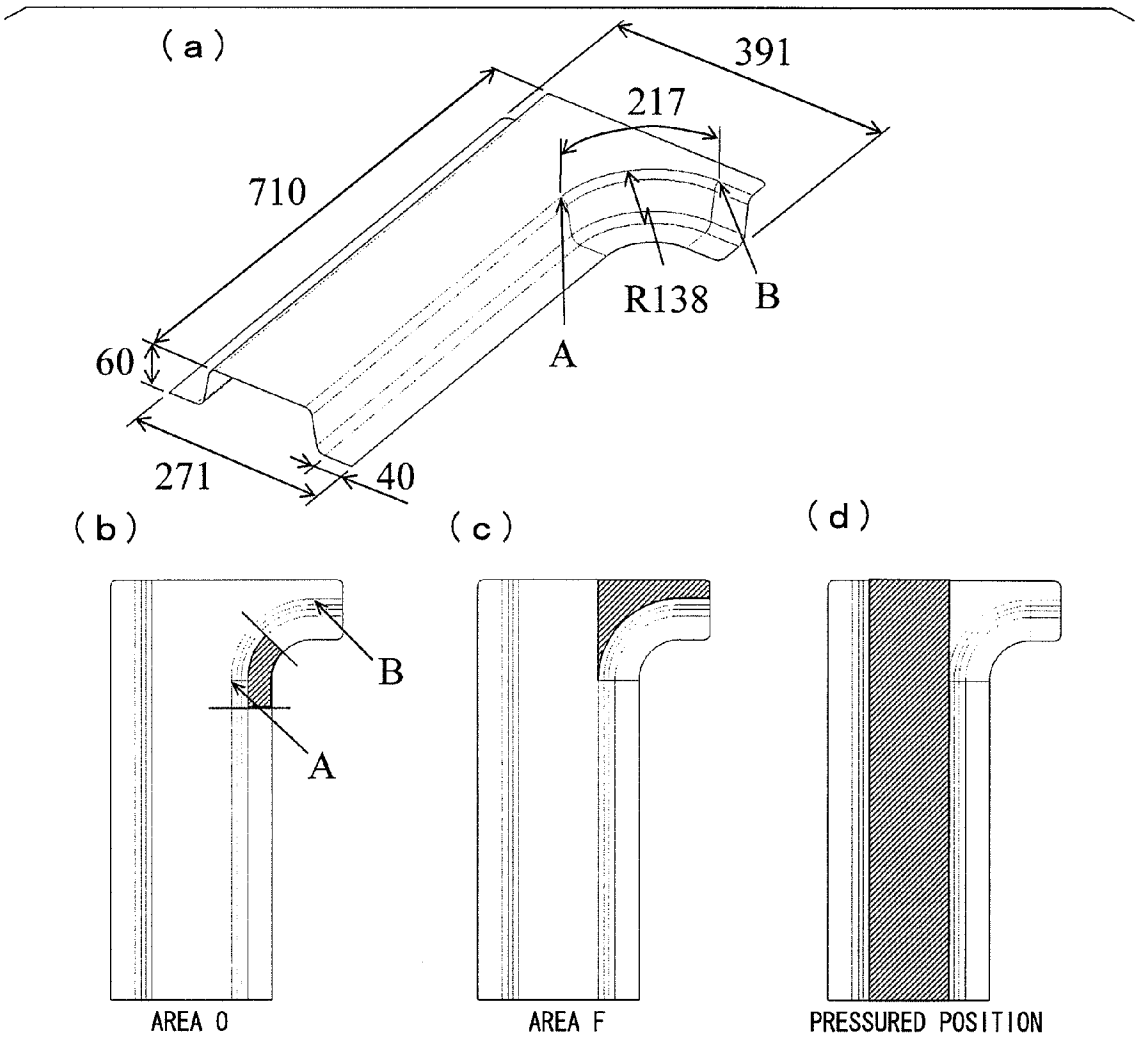
FIG. 12 is a diagram for explaining a formed body in Example 4.
Figure 13:
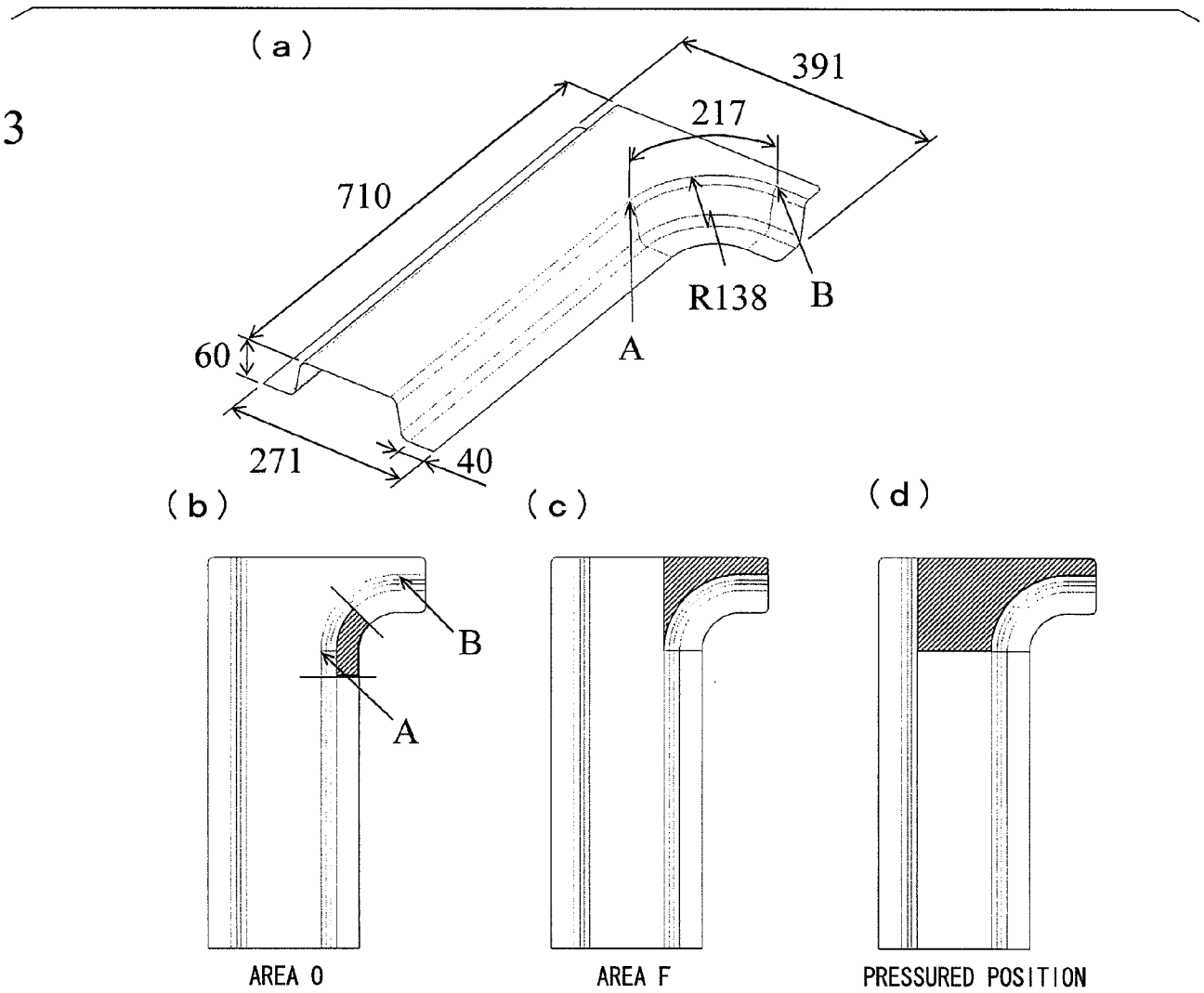
FIG. 13 is a diagram for explaining a formed body in Example 5.
Figure 14:
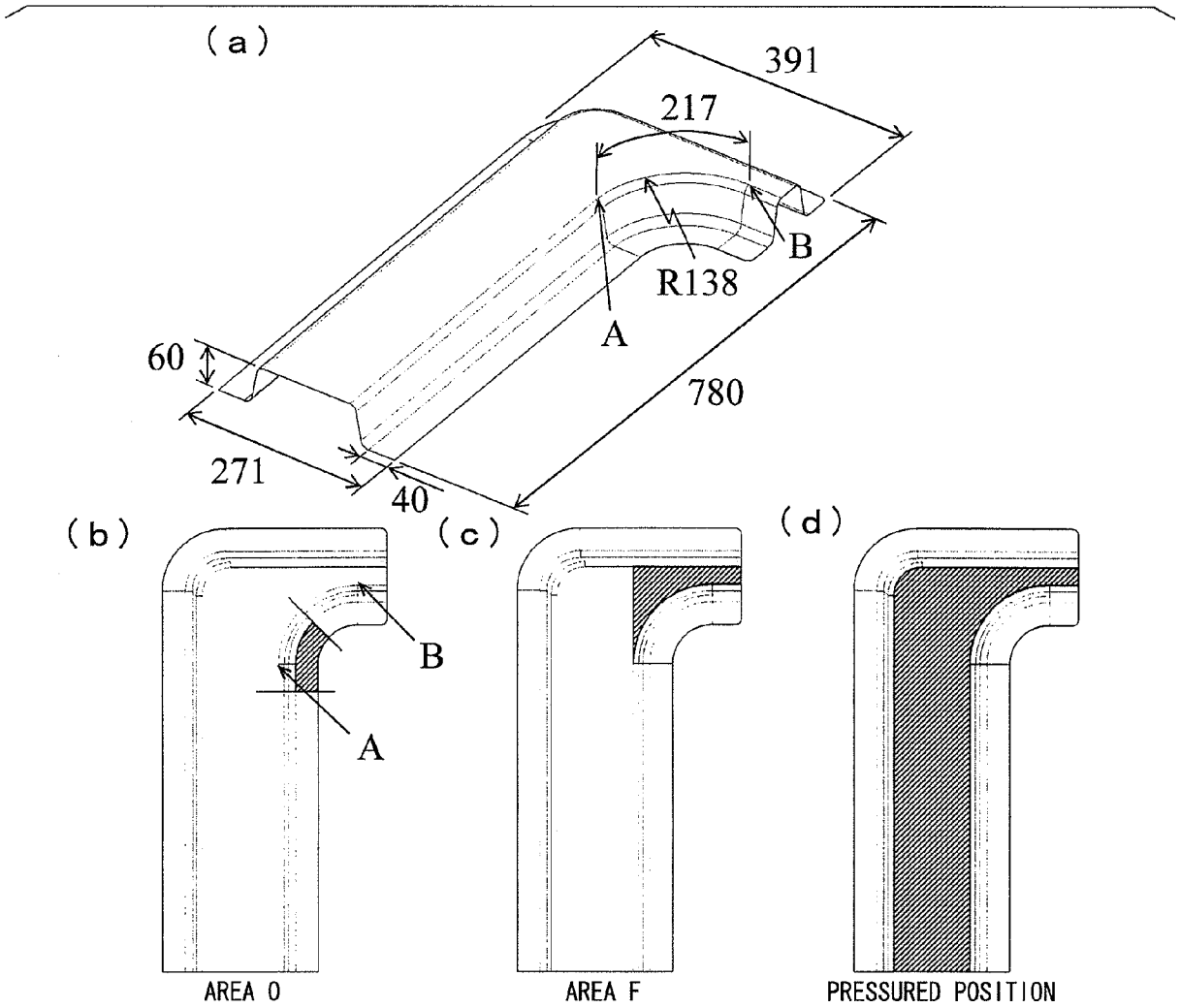
FIG. 14 is a diagram for explaining a formed body in Example 6.
Figure 15:
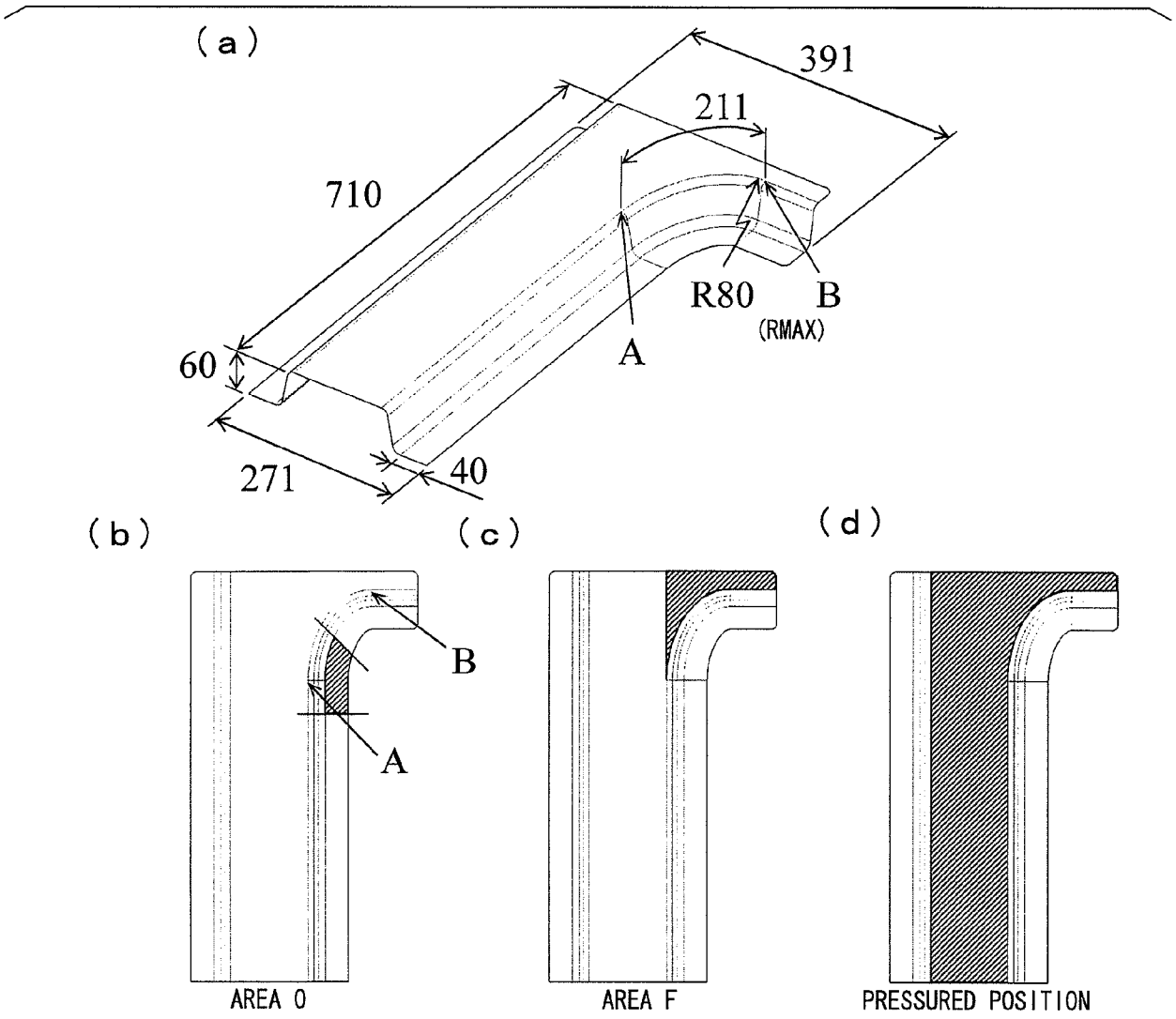
FIG. 15 is a diagram for explaining a formed body in Example 7.
Figure 16:
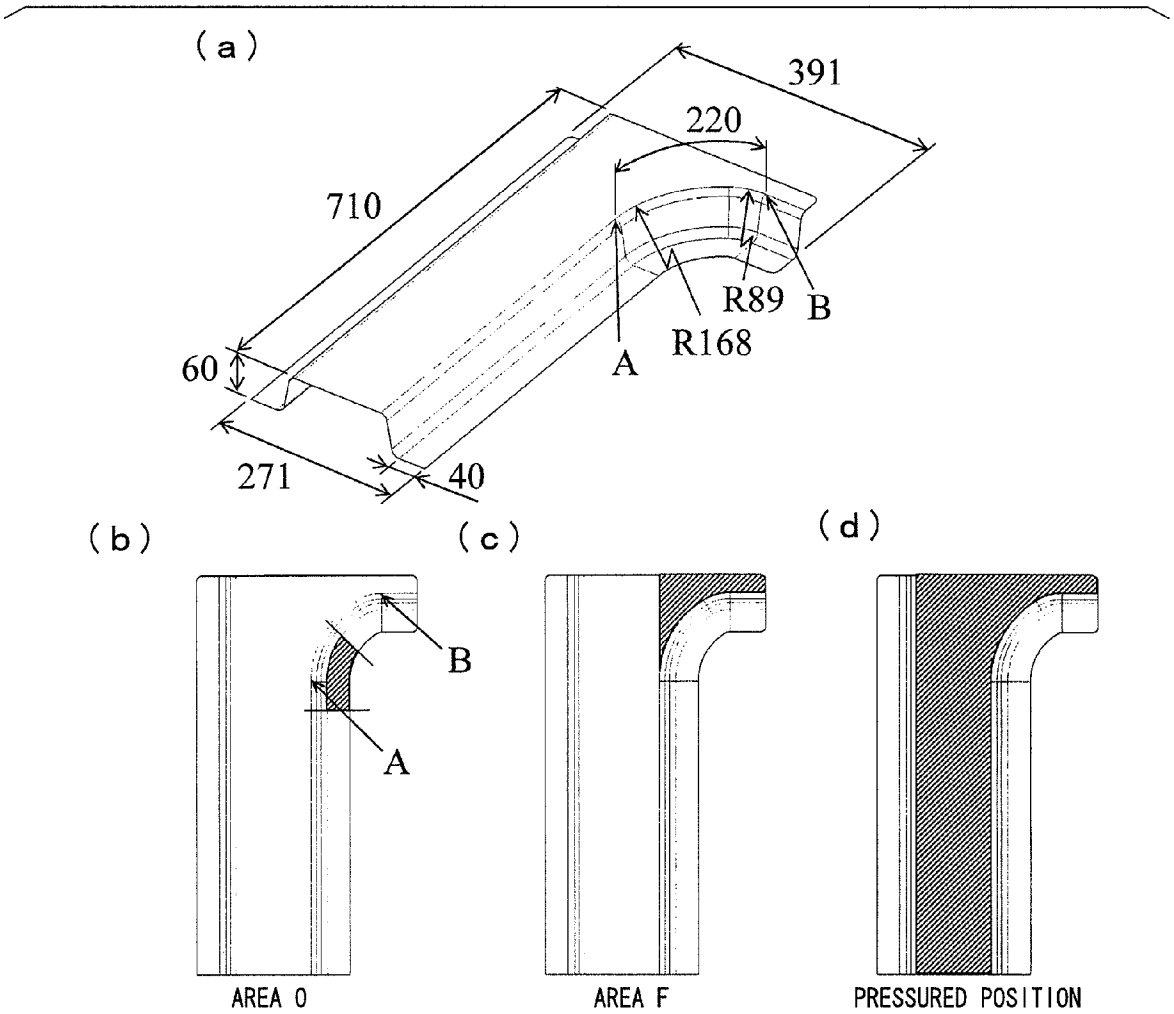
FIG. 16 is a diagram for explaining a formed body in Example 8.
Figure 17:
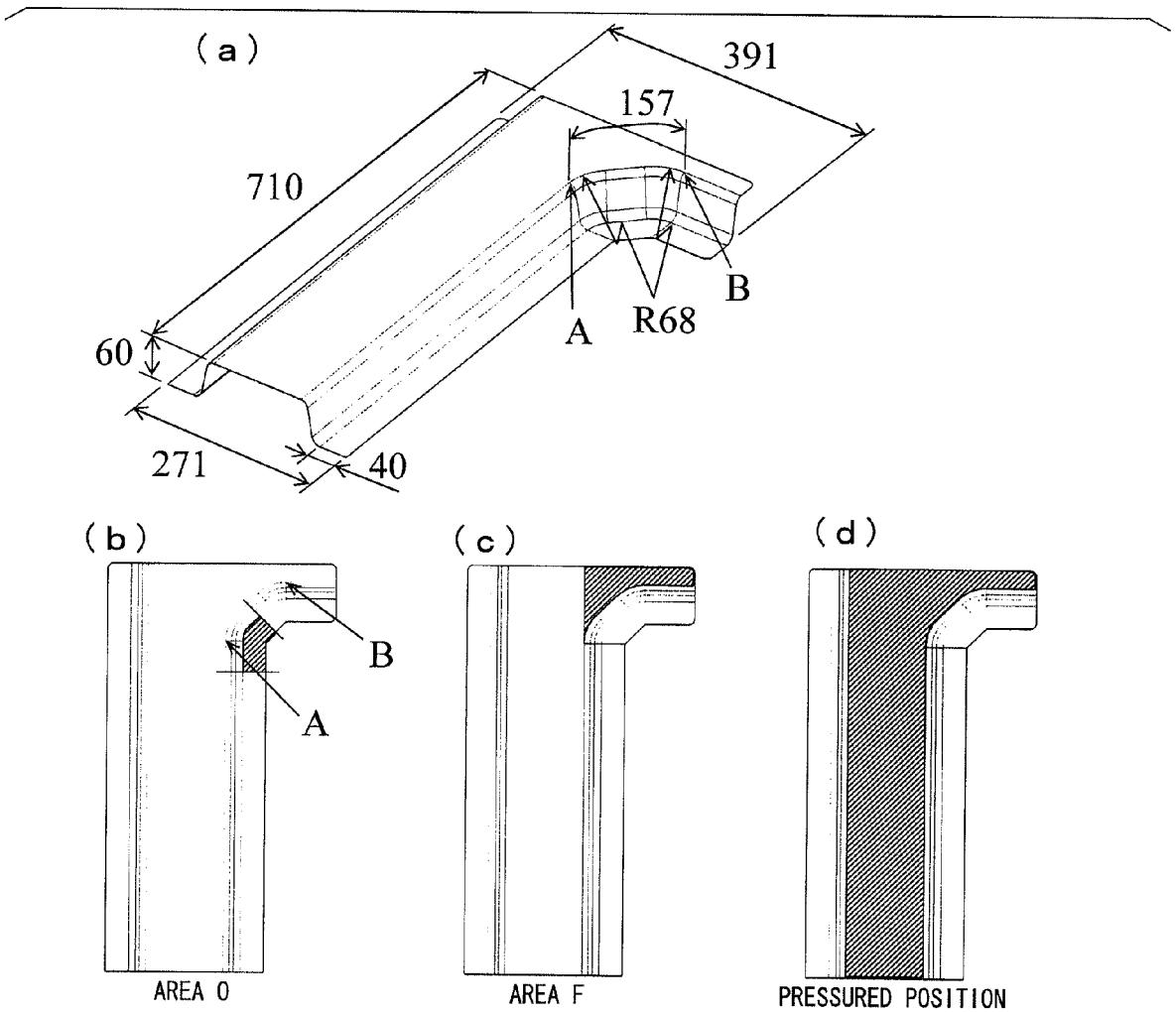
FIG. 17 is a diagram for explaining a formed body in Example 9.
Figure 18:
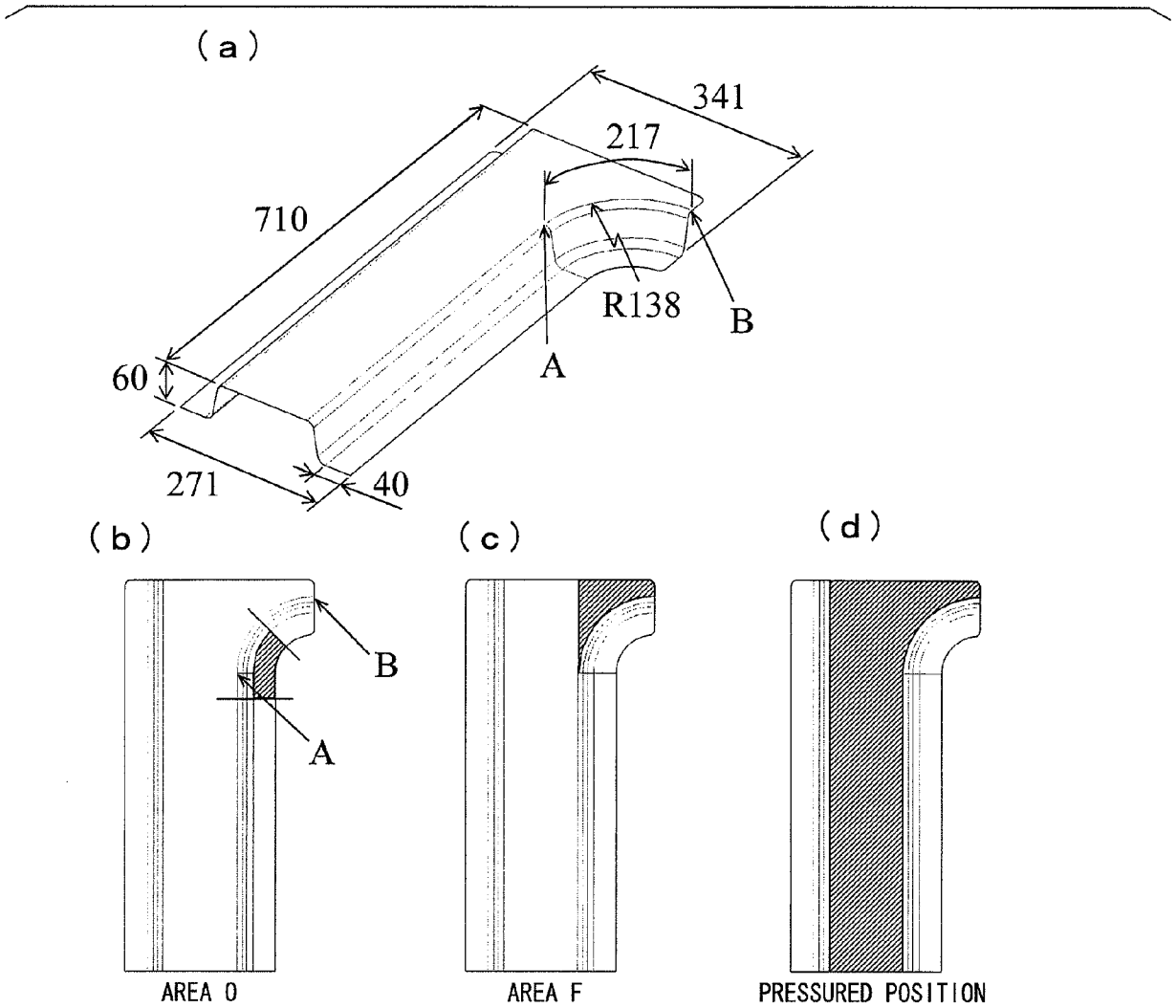
FIG. 18 is a diagram for explaining a formed body in Example 10.
Figure 19:
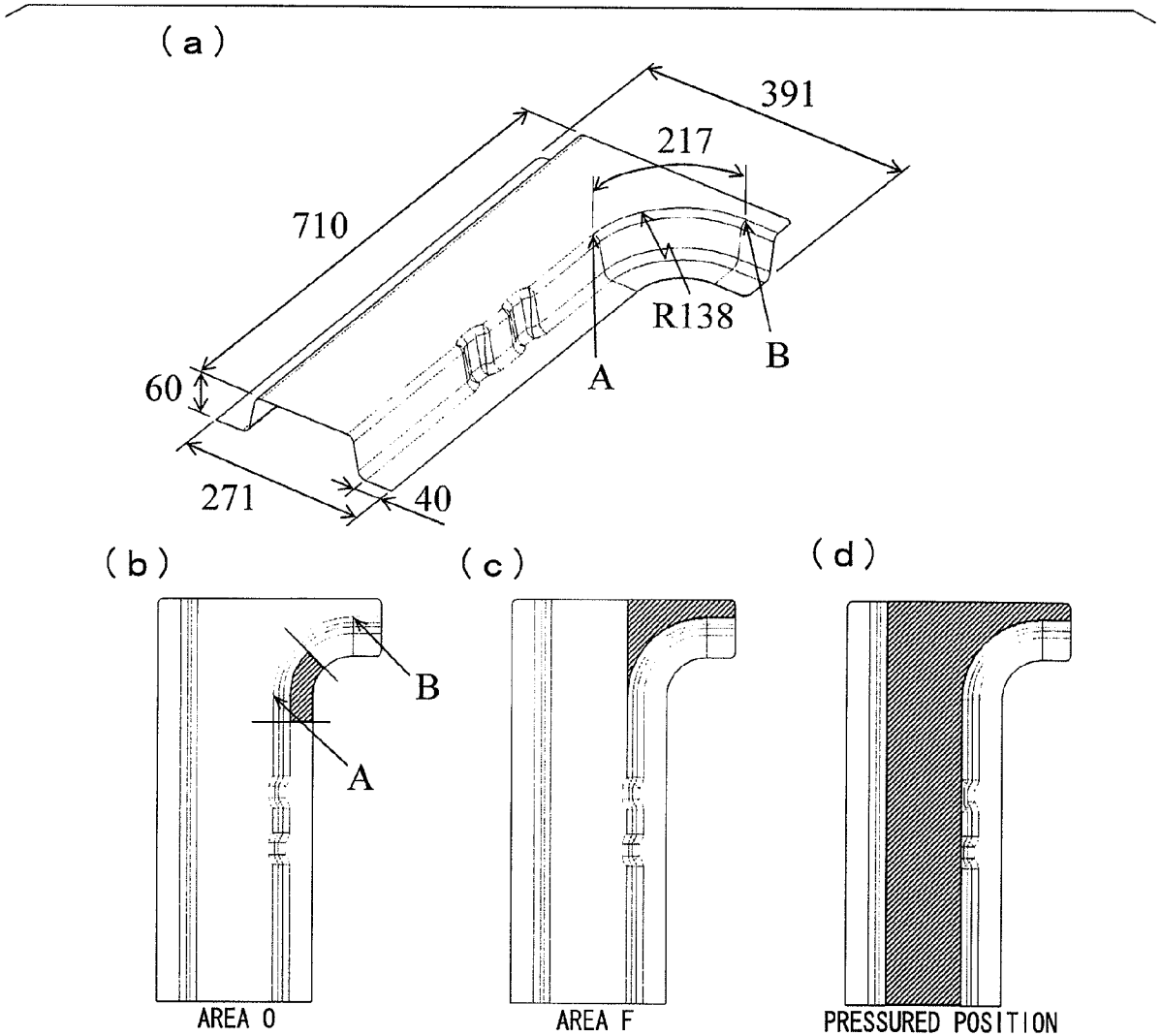
FIG. 19 is a diagram for explaining a formed body in Example 11.
Figure 20:
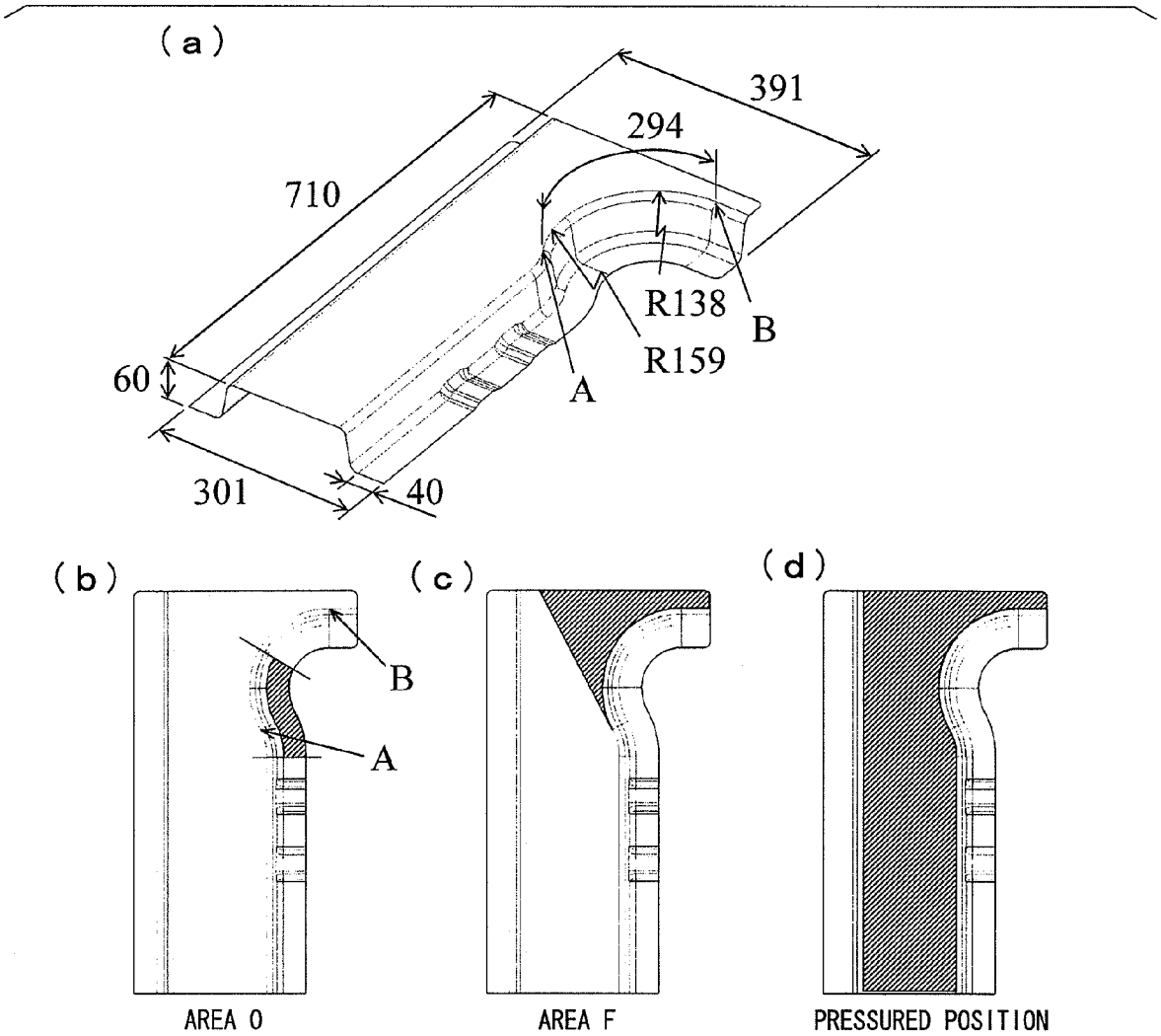
FIG. 20 is a diagram for explaining a formed body in Example 12.

| | Corresponding figure | Material | | |
|---|---|---|---|---|
| | | Metal sheet type | Sheet thickness (mm) | Breaking strength MPa |
| Example 1 | FIG. 11 | Steel sheet | 1.2 | 980 |
| Example 2 | FIG. 11 | Steel sheet | 1.2 | 980 |
| Example 3 | FIG. 11 | Steel sheet | 1.2 | 980 |
| Example 41 | FIG. 11 | Steel sheet | 1.6 | 590 |
| Example 42 | FIG. 11 | Steel sheet | 1.6 | 590 |
| Example 43 | FIG. 11 | Steel sheet | 1.6 | 590 |
| Example 44 | FIG. 11 | Steel sheet | 1.8 | 270 |
| Example 45 | FIG. 11 | Steel sheet | 1.2 | 980 |
| Example 46 | FIG. 11 | Steel sheet | 1.2 | 980 |
| Example 47 | FIG. 11 | Steel sheet | 1.2 | 980 |
| Example 48 | FIG. 11 | Steel sheet | 1.2 | 980 |
| Example 49 | FIG. 11 | Steel sheet | 1.2 | 980 |
| Example 50 | FIG. 11 | Steel sheet | 1.6 | 590 |
| Example 51 | FIG. 11 | Steel sheet | 1.6 | 590 |
| Example 52 | FIG. 11 | Steel sheet | 1.6 | 590 |
| Example 4 | FIG. 12 | Steel sheet | 1.2 | 980 |
| Example 5 | FIG. 13 | Steel sheet | 1.2 | 980 |
| Example 6 | FIG. 14 | Steel sheet | 1.2 | 980 |
| Example 7 | FIG. 15 | Steel sheet | 2.3 | 440 |
| Example 8 | FIG. 16 | Steel sheet | 0.8 | 590 |
| Example 9 | FIG. 17 | Steel sheet | 1.6 | 1180 |
| Example 10 | FIG. 18 | Steel sheet | 1.2 | 1380 |
| Example 11 | FIG. 19 | Steel sheet | 1.2 | 980 |
| Example 12 | FIG. 20 | Steel sheet | 1.2 | 980 |

TABLE 1A-continued

Figure 21:
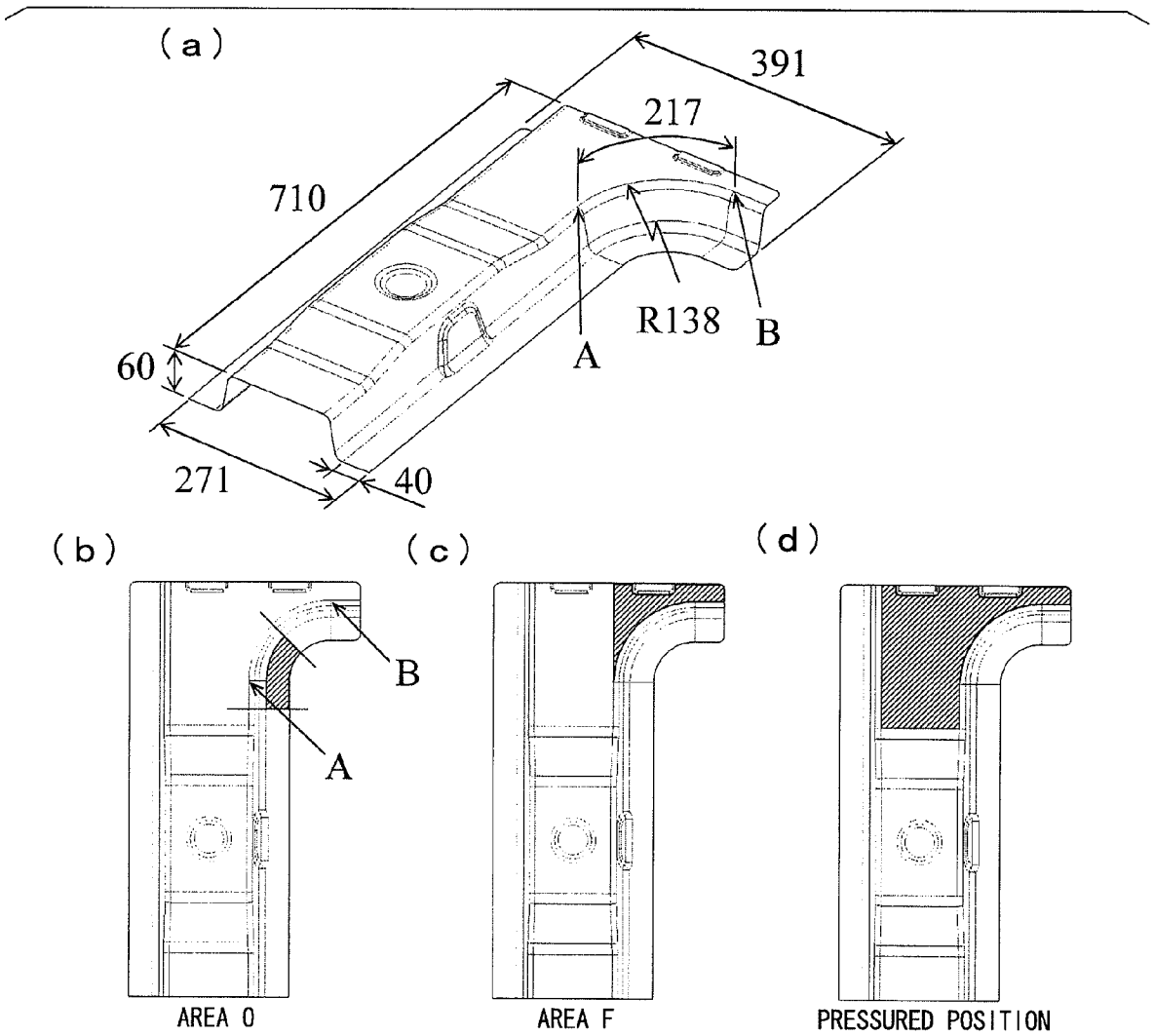
FIG. 21 is a diagram for explaining a formed body in Example 13.
Figure 22:
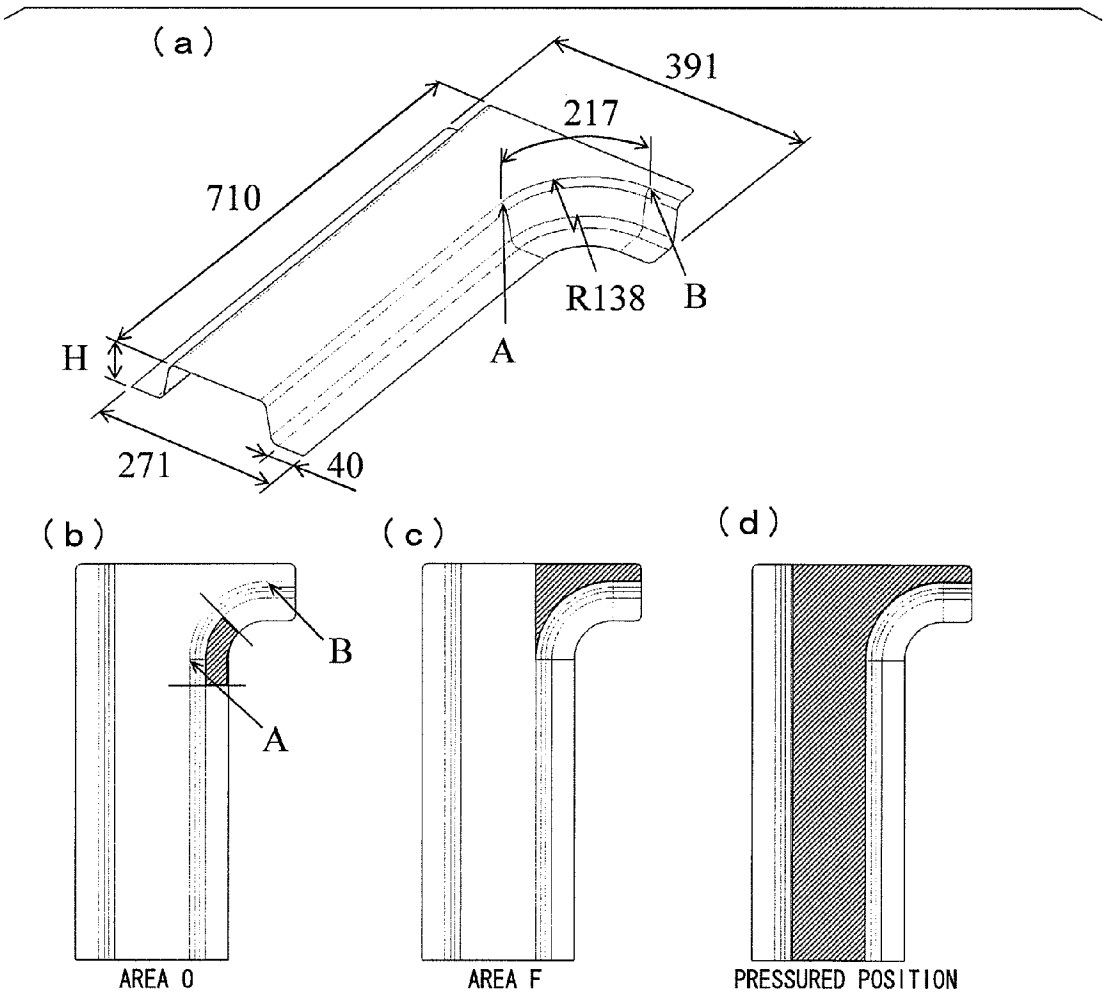
FIG. 22 is a diagram for explaining formed bodies in Examples 14 to 17.

| | Corresponding figure | Material | | |
|---|---|---|---|---|
| | | Metal sheet type | Sheet thickness (mm) | Breaking strength MPa |
| Example 13 | FIG. 21 | Steel sheet | 1.2 | 980 |
| Example 14 | FIG. 22 | Steel sheet | 1.2 | 980 |

TABLE 1B

Figure 23:
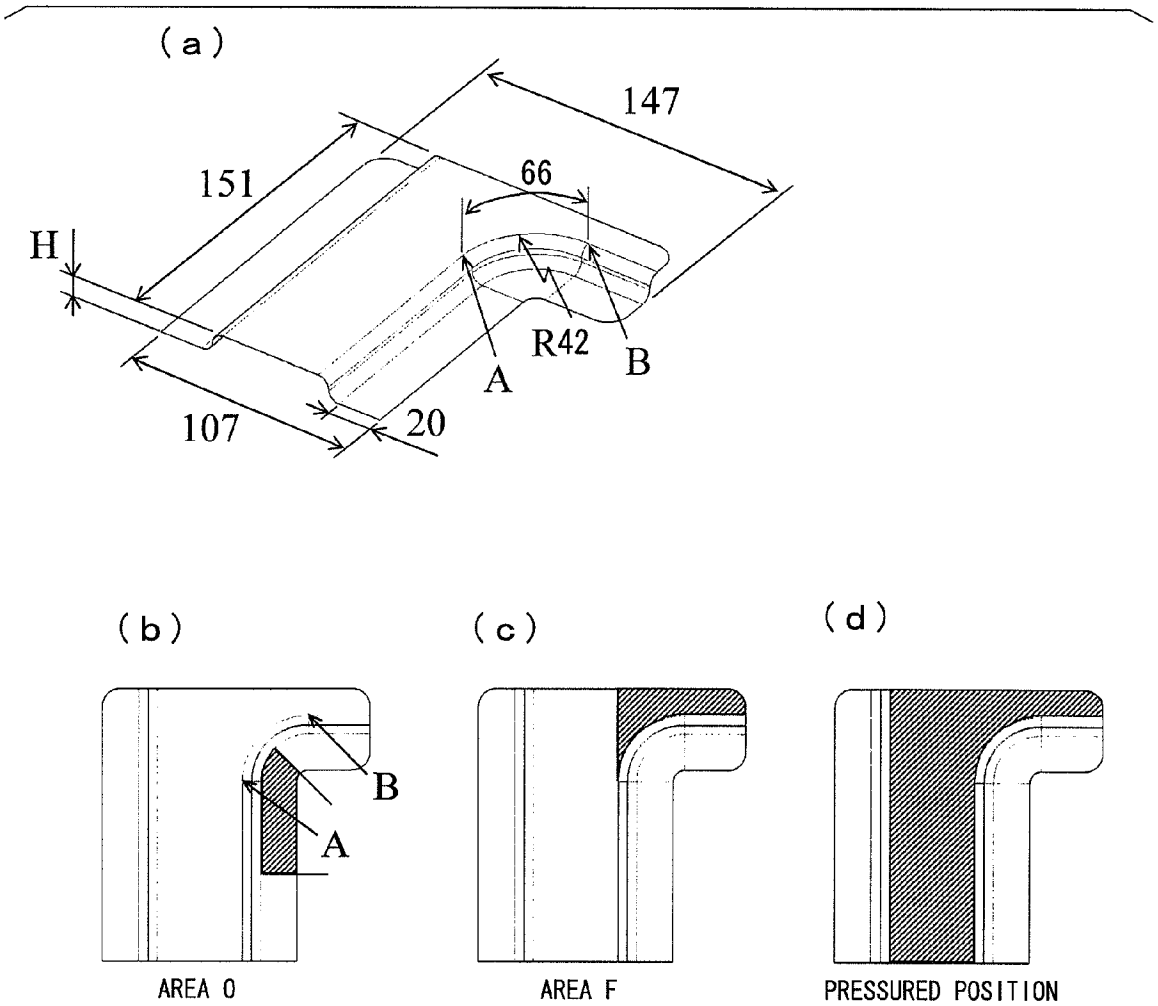
FIG. 23 is a diagram for explaining formed bodies in Examples 18 to 20.
Figure 24:
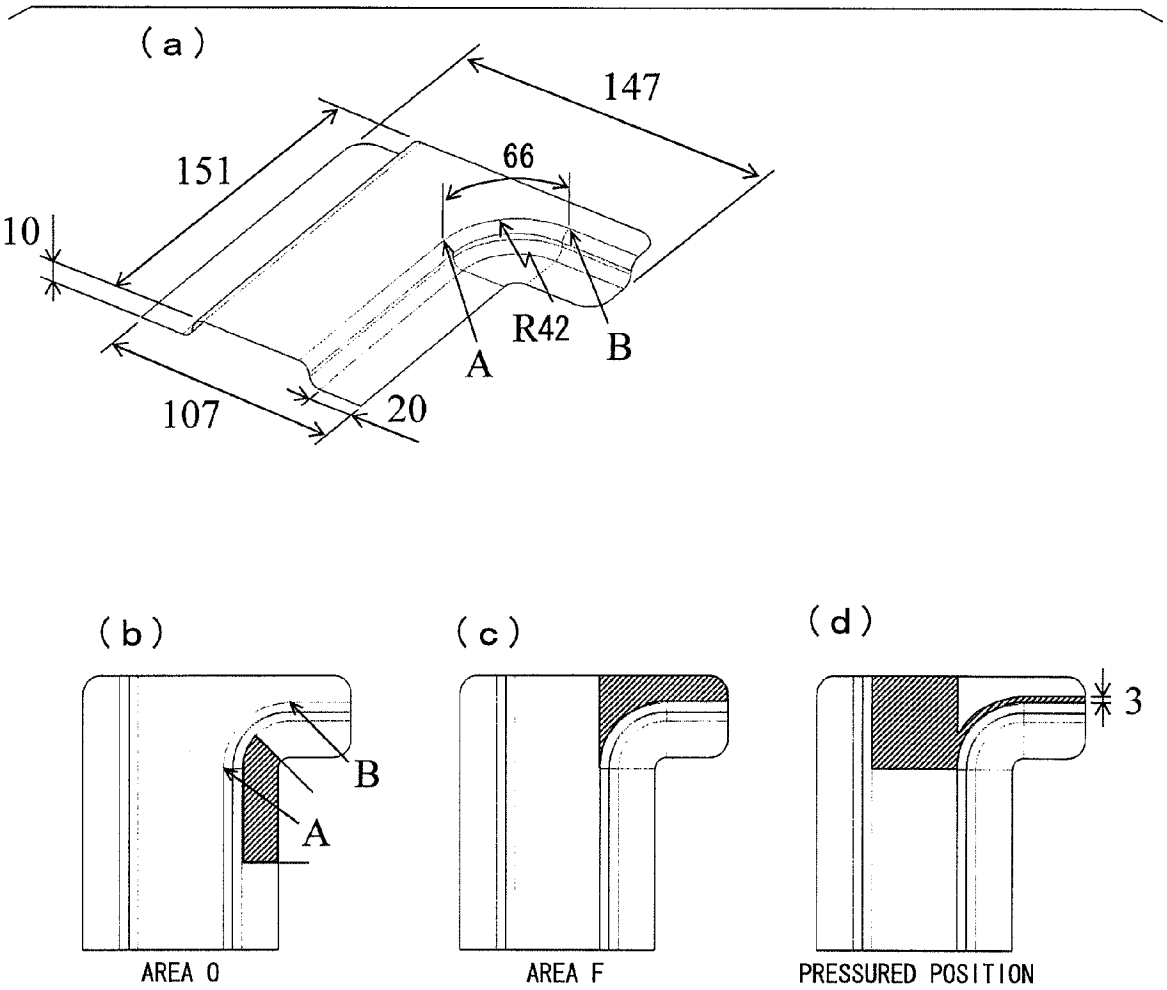
FIG. 24 is a diagram for explaining a formed body in Example 21.
Figure 25:
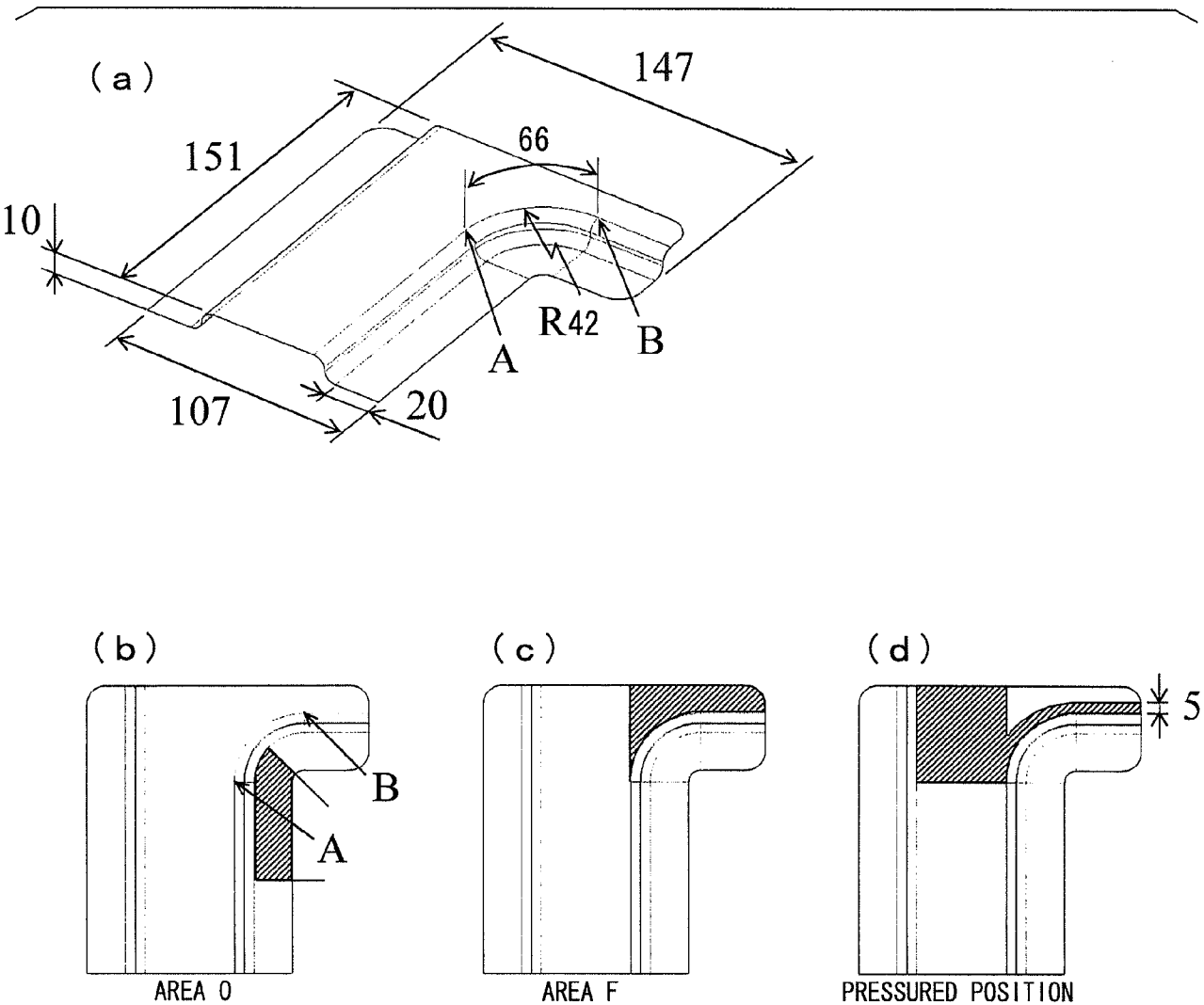
FIG. 25 is a diagram for explaining a formed body in Example 22.
Figure 26:
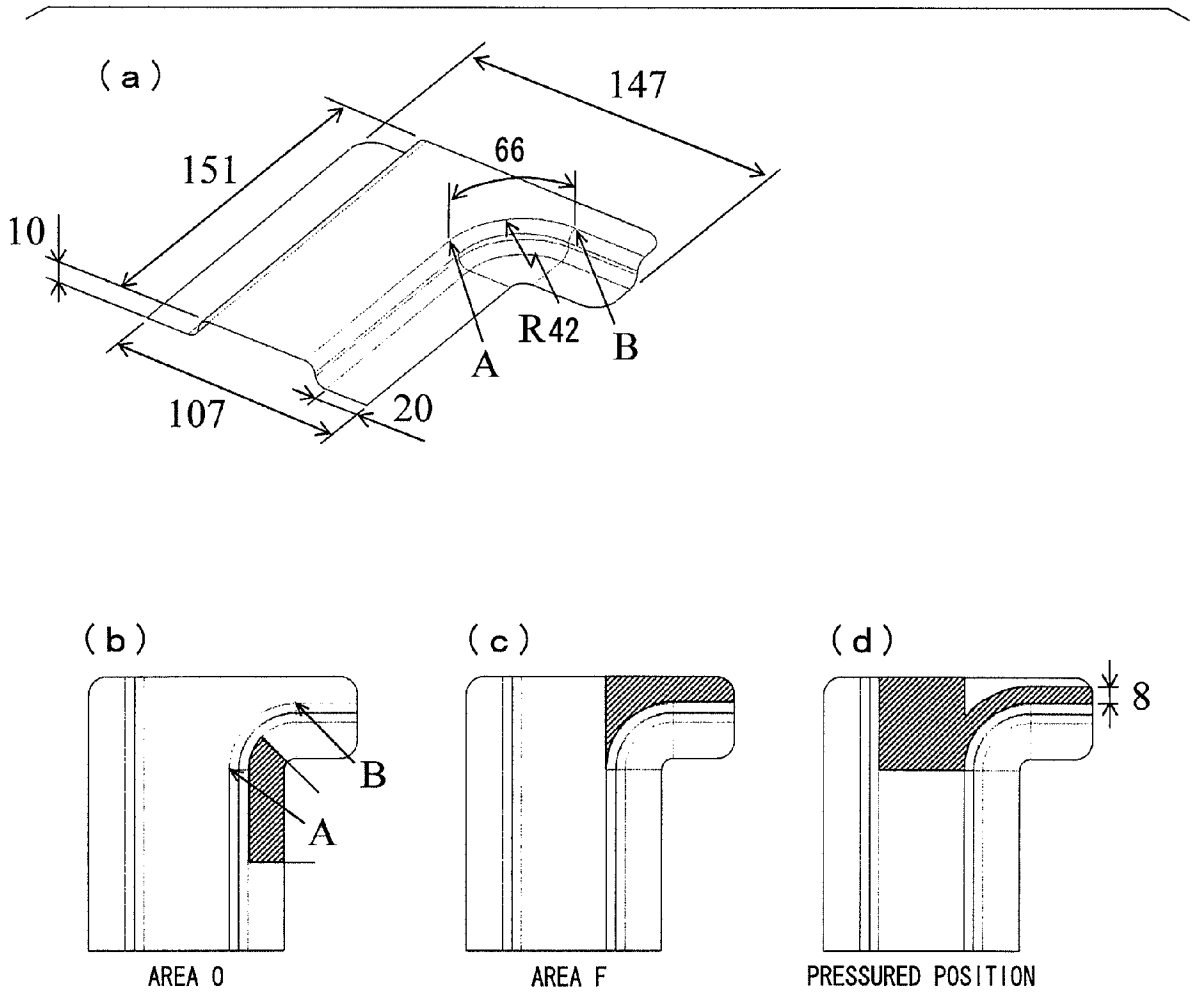
FIG. 26 is a diagram for explaining a formed body in Example 23.
Figure 27:
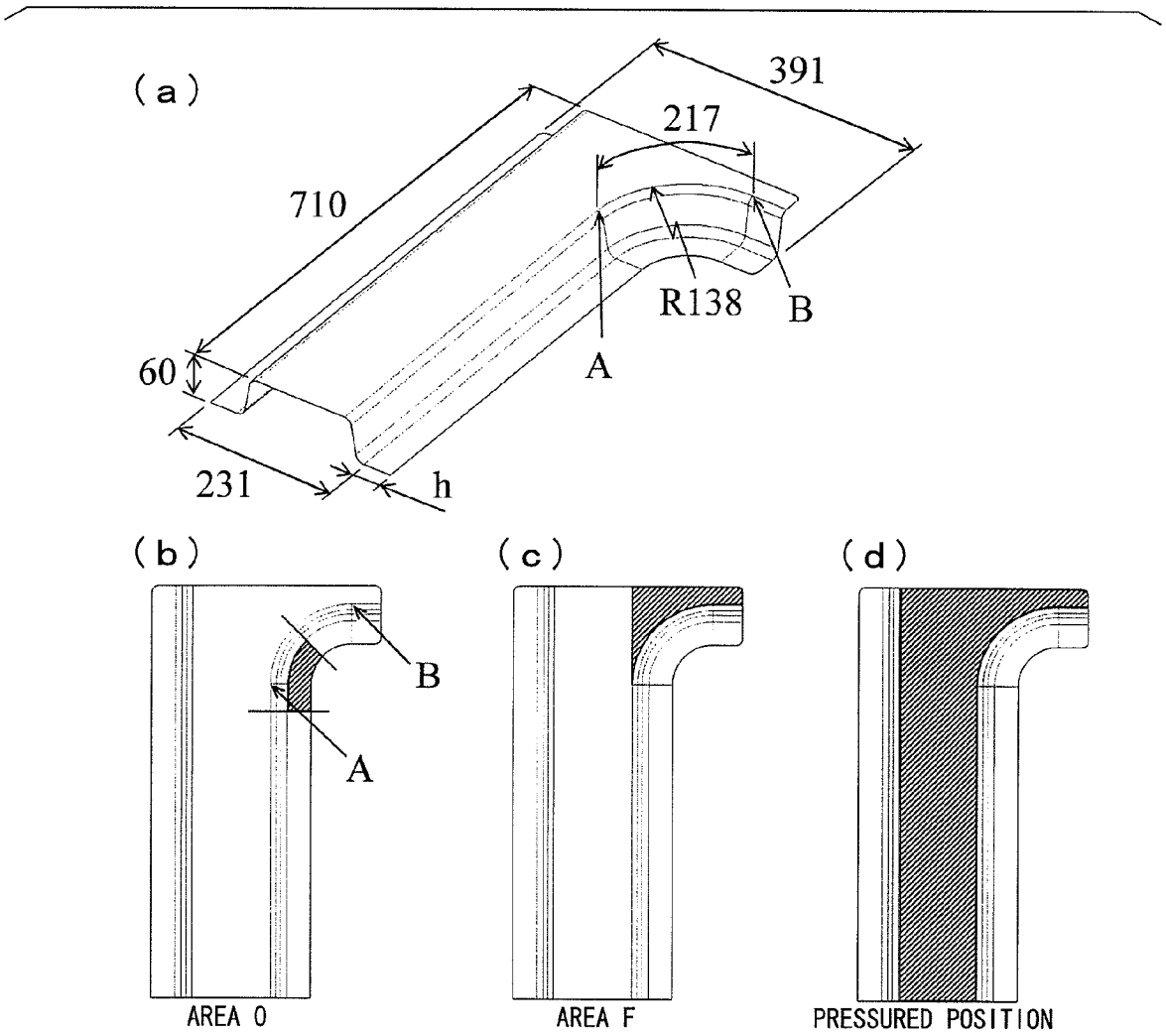
FIG. 27 is a diagram for explaining formed bodies in Examples 24 to 28.
Figure 28:
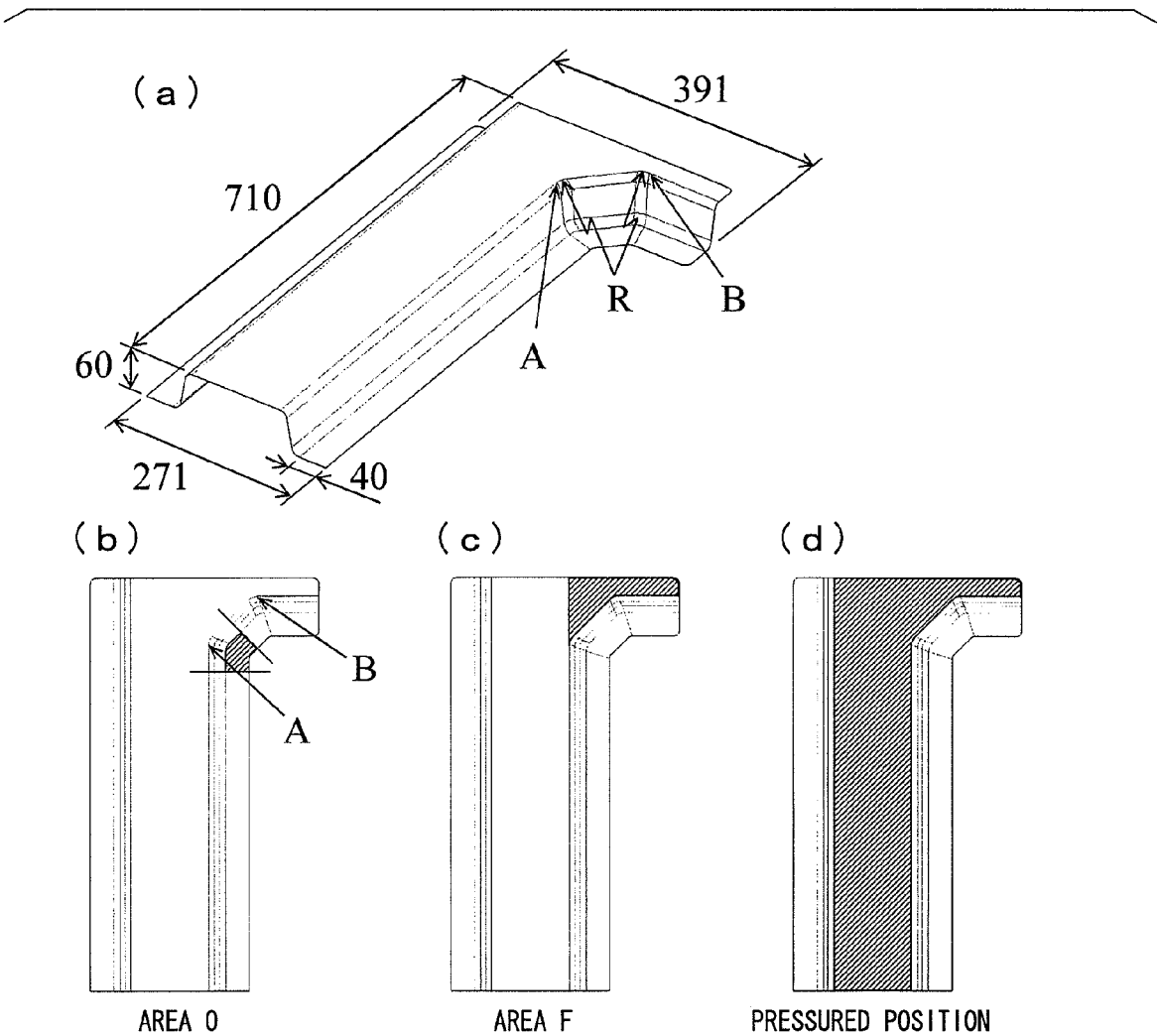
FIG. 28 is a diagram for explaining formed bodies in Examples 29 to 32.
Figure 29:
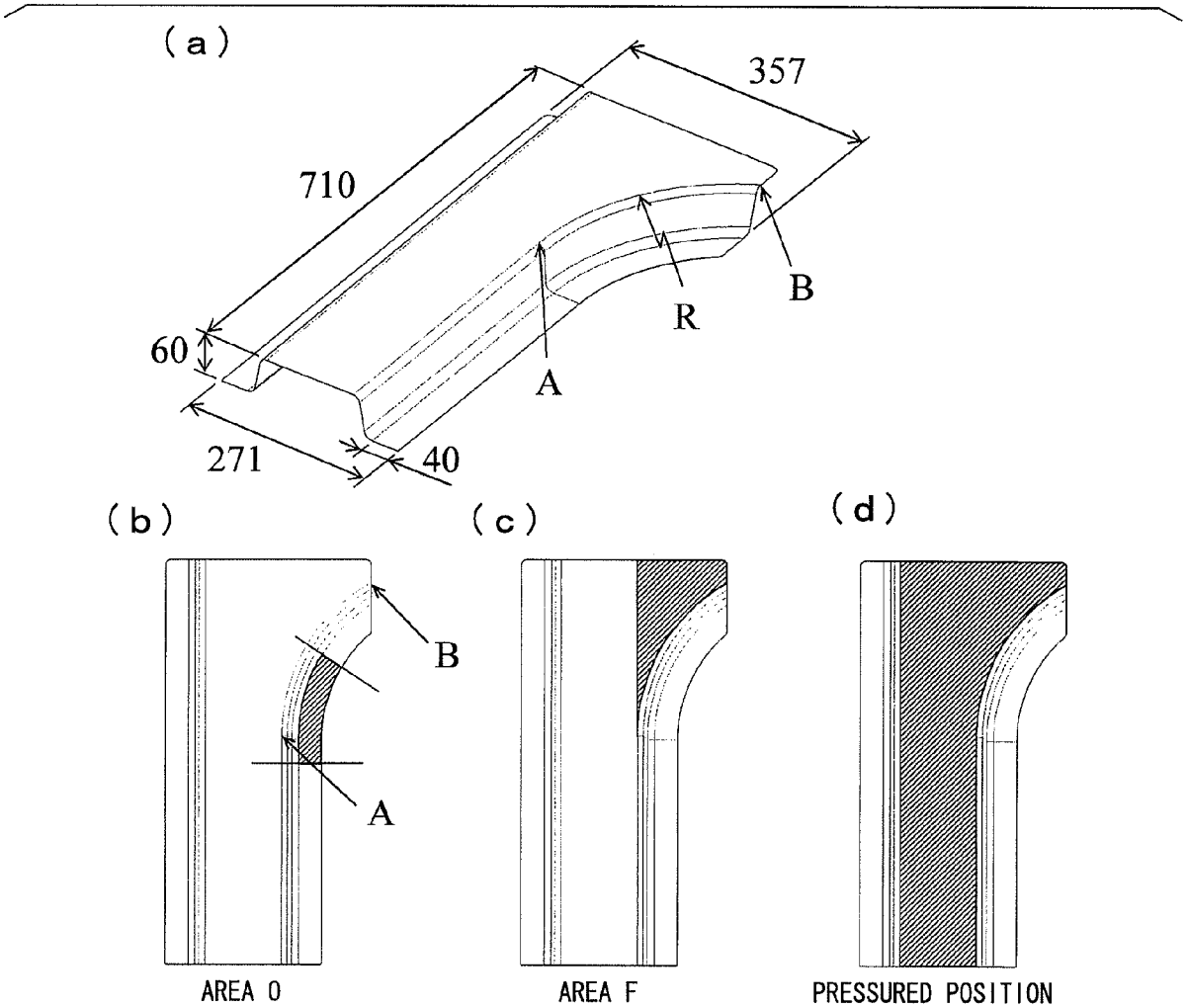
FIG. 29 is a diagram for explaining formed bodies in Examples 33 to 36.
Figure 30:
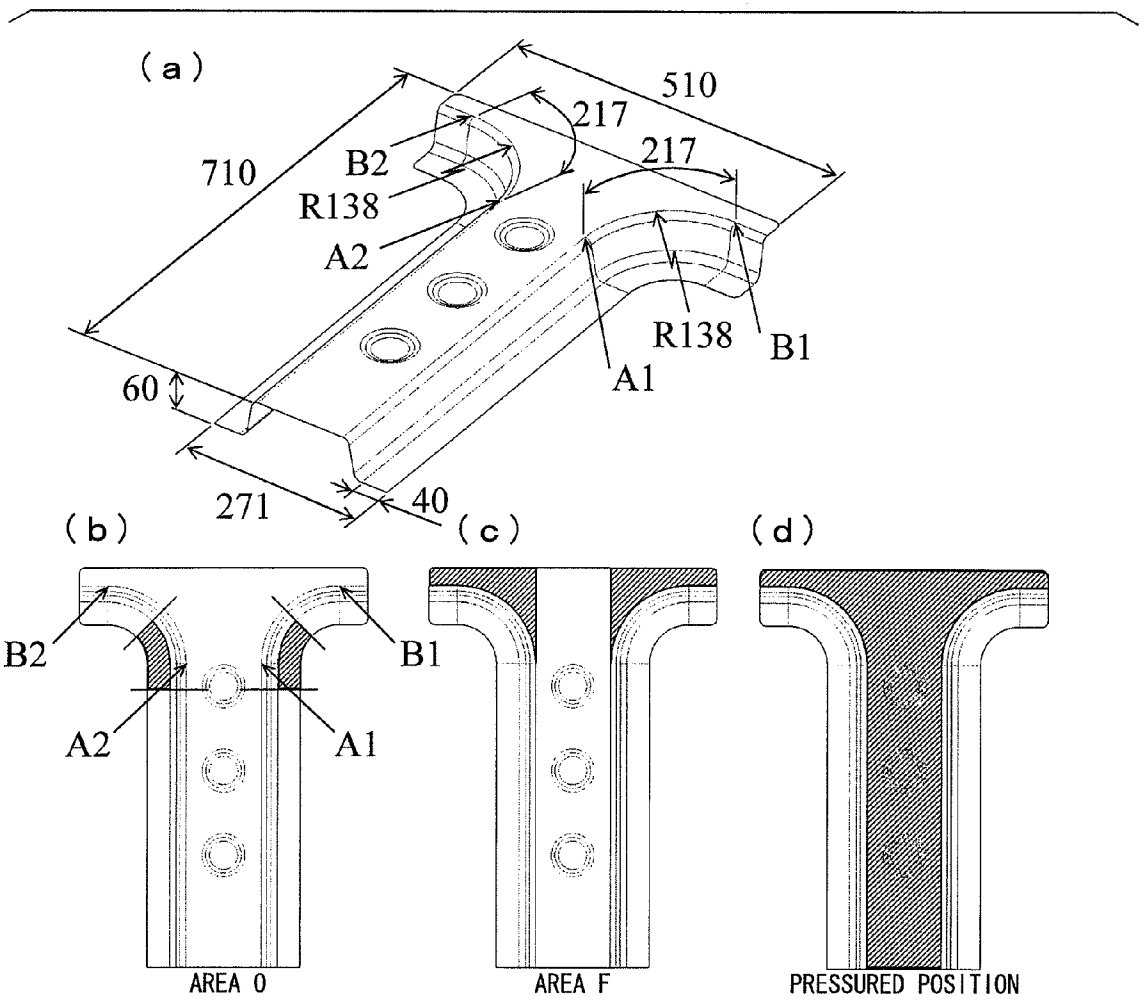
FIG. 30 is a diagram for explaining formed bodies in Examples 37 to 38.
Figure 31:
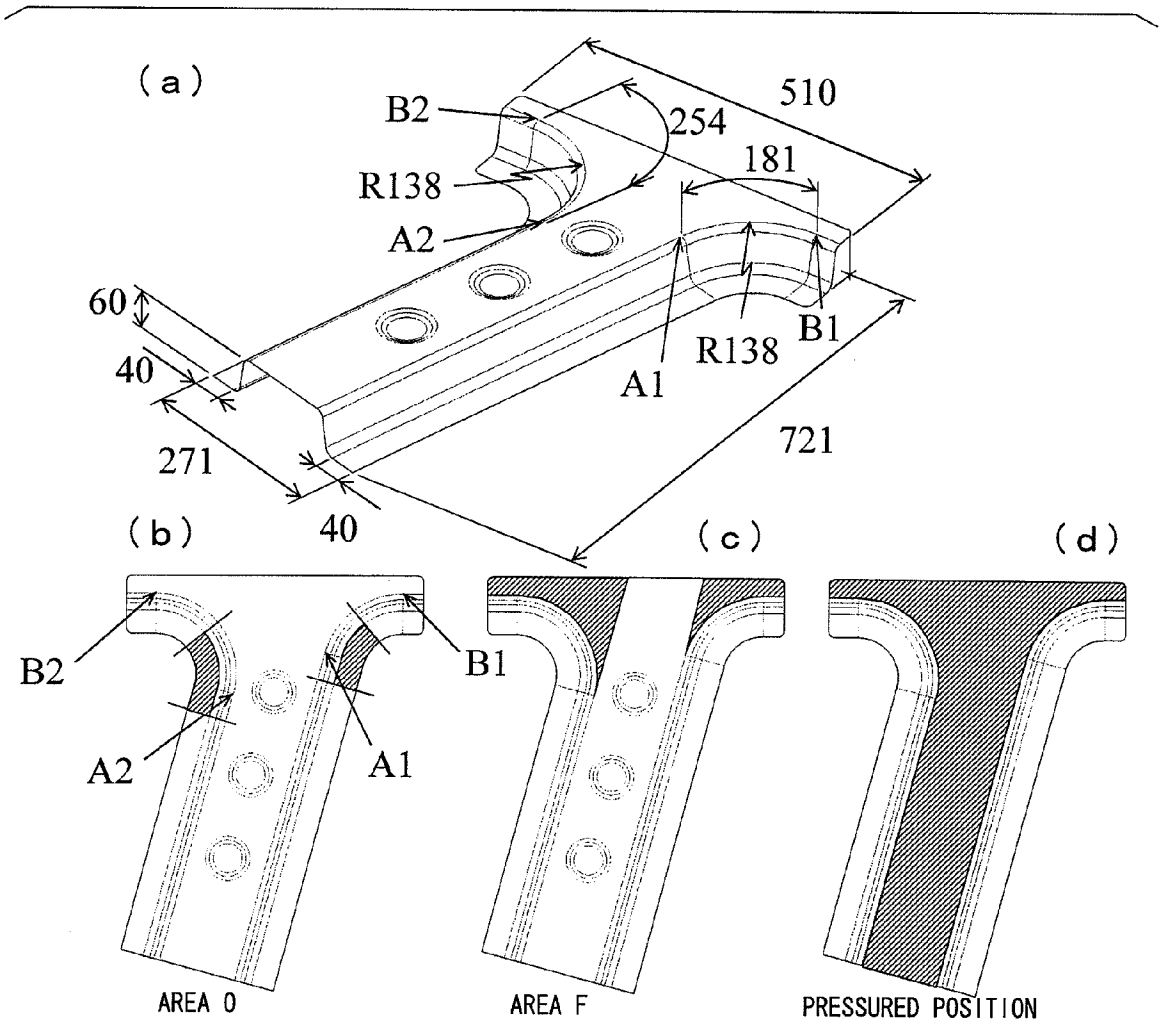
FIG. 31 is a diagram for explaining a formed body in Example 39.
Figure 32:
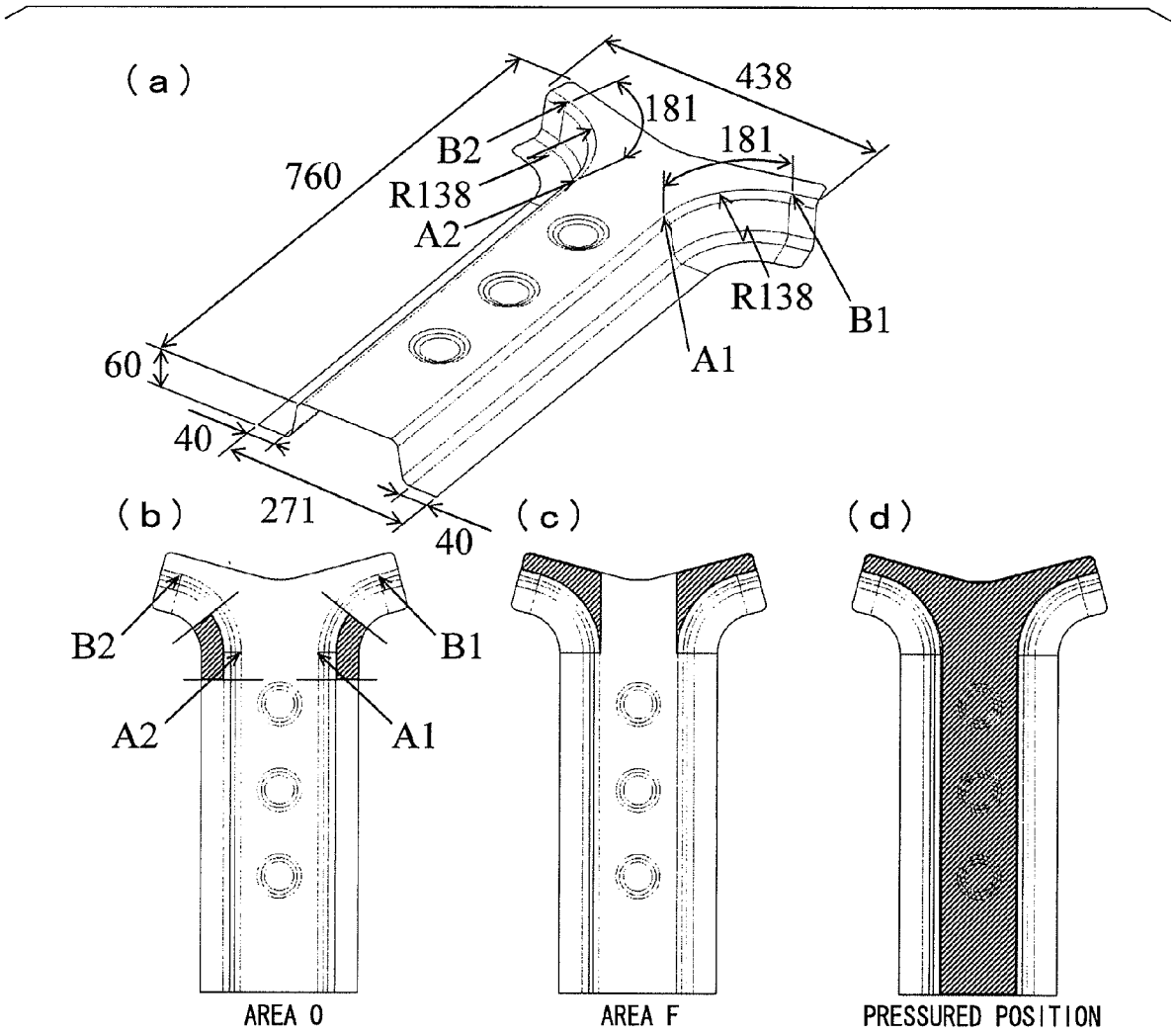
FIG. 32 is a diagram for explaining a formed body in Example 40.
Figure 33:
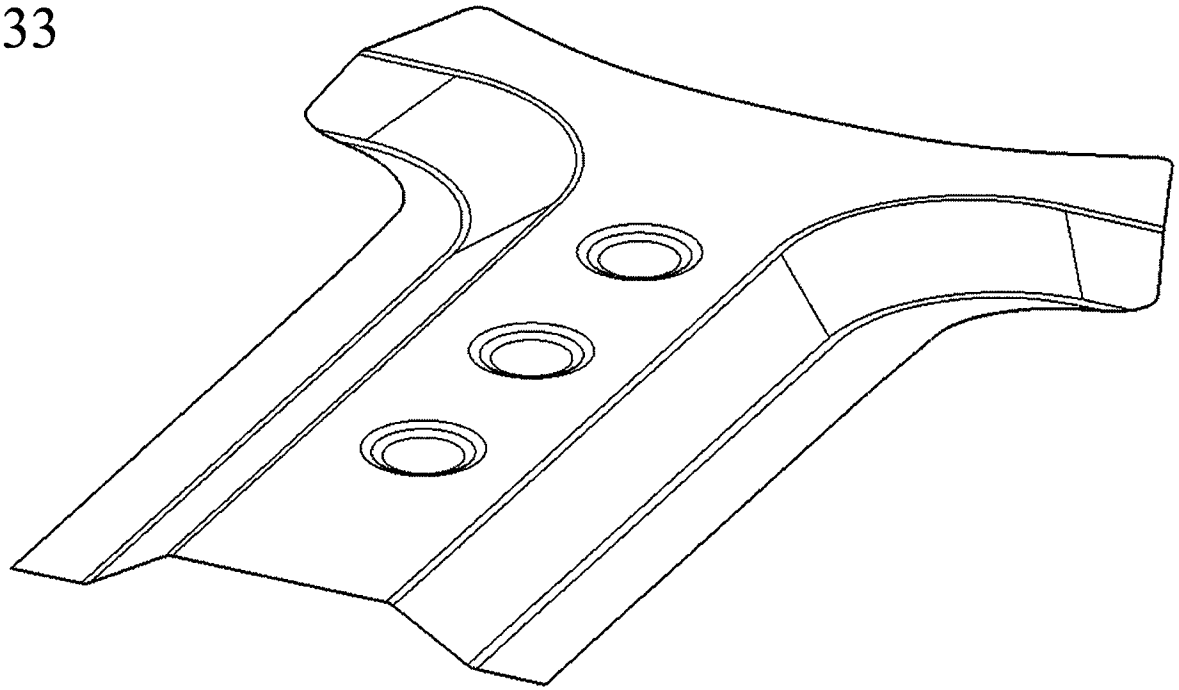
FIG. 33 is a diagram showing the shape of a pre-processed metal sheet used in Examples 37 and 38.

| | Corresponding figure | Material | | |
|---|---|---|---|---|
| | | Metal sheet type | Sheet thickness (mm) | Breaking strength MPa |
| Example 15 | FIG. 22 | Steel sheet | 1.2 | 980 |
| Example 16 | FIG. 22 | Steel sheet | 1.2 | 980 |
| Example 17 | FIG. 22 | Steel sheet | 1.2 | 980 |
| Example 18 | FIG. 23 | Steel sheet | 0.8 | 980 |
| Example 19 | FIG. 23 | Steel sheet | 0.8 | 980 |
| Example 20 | FIG. 23 | Steel sheet | 0.8 | 980 |
| Example 21 | FIG. 24 | Steel sheet | 1.2 | 980 |
| Example 22 | FIG. 25 | Steel sheet | 1.2 | 980 |
| Example 23 | FIG. 26 | Steel sheet | 1.2 | 980 |
| Example 24 | FIG. 27 | Steel sheet | 1.2 | 980 |
| Example 25 | FIG. 27 | Steel sheet | 1.2 | 980 |
| Example 26 | FIG. 27 | Steel sheet | 1.2 | 980 |
| Example 27 | FIG. 27 | Steel sheet | 1.2 | 980 |
| Example 28 | FIG. 27 | Steel sheet | 1.2 | 980 |
| Example 29 | FIG. 28 | Steel sheet | 1.2 | 270 |
| Example 30 | FIG. 28 | Steel sheet | 1.2 | 270 |
| Example 31 | FIG. 28 | Steel sheet | 1.2 | 270 |
| Example 32 | FIG. 28 | Steel sheet | 1.2 | 270 |
| Example 33 | FIG. 29 | Steel sheet | 1.2 | 270 |
| Example 34 | FIG. 29 | Steel sheet | 1.2 | 270 |
| Example 35 | FIG. 29 | Steel sheet | 1.2 | 270 |
| Example 36 | FIG. 29 | Steel sheet | 1.2 | 270 |
| Example 37 | FIGS. 30, 33 | Steel sheet | 1.8 | 980 |
| Example 38 | FIGS. 30, 33 | Aluminum | 1.8 | 296 |
| Example 39 | FIG. 31 | Steel sheet | 1.8 | 980 |
| Example 40 | FIG. 32 | Steel sheet | 1.8 | 980 |

TABLE 2A

| | Shape | | | | | | | | | |
|---|---|---|---|---|---|---|---|---|---|---|
| | Top sheet shape | Arc length (mm) | Arc length × 0.2 | Radius of curvature of maximum curvature portion of arc (mm) | Height H of vertical wall section (mm) | End flange width (mm) | Shape of arc | Winding of end portion | Shape of front of A end | Additional shape of top sheet section |
| Example 1 | L | 217 | 43.4 | 138 | 60 | 40 | R | No | Straight | No |
| Example 2 | L | 217 | 43.4 | 138 | 60 | 40 | R | No | Straight | No |
| Example 3 | L | 217 | 43.4 | 138 | 60 | 40 | R | No | Straight | No |
| Example 41 | L | 217 | 43.4 | 138 | 60 | 40 | R | No | Straight | No |
| Example 42 | L | 217 | 43.4 | 138 | 60 | 40 | R | No | Straight | No |
| Example 43 | L | 217 | 43.4 | 138 | 60 | 40 | R | No | Straight | No |
| Example 44 | L | 217 | 43.4 | 138 | 60 | 40 | R | No | Straight | No |
| Example 45 | L | 217 | 43.4 | 138 | 60 | 40 | R | No | Straight | No |
| Example 46 | L | 217 | 43.4 | 138 | 60 | 40 | R | No | Straight | No |
| Example 47 | L | 217 | 43.4 | 138 | 60 | 40 | R | No | Straight | No |
| Example 48 | L | 217 | 43.4 | 138 | 60 | 40 | R | No | Straight | No |
| Example 49 | L | 217 | 43.4 | 138 | 60 | 40 | R | No | Straight | No |
| Example 50 | L | 217 | 43.4 | 138 | 60 | 40 | R | No | Straight | No |
| Example 51 | L | 217 | 43.4 | 138 | 60 | 40 | R | No | Straight | No |
| Example 52 | L | 217 | 43.4 | 138 | 60 | 40 | R | No | Straight | No |
| Example 4 | L | 217 | 43.4 | 138 | 60 | 40 | R | No | Straight | No |
| Example 5 | L | 217 | 43.4 | 138 | 60 | 40 | R | No | Straight | No |
| Example 6 | L | 217 | 43.4 | 138 | 60 | 40 | R | Yes | Straight | No |
| Example 7 | L | 211 | 42.2 | 80 | 60 | 40 | Elliptical | No | Straight | No |
| Example 8 | L | 220 | 44 | 89 | 60 | 40 | Complex R | No | Straight | No |
| Example 9 | L | 157 | 31.4 | 68 | 60 | 40 | R + Straight + R | No | Straight | No |

TABLE 2A-continued

| | Shape | | | | | | | | | |
|---|---|---|---|---|---|---|---|---|---|---|
| | Top sheet shape | Arc length (mm) | Arc length × 0.2 | Radius of curvature of maximum curvature portion of arc (mm) | Height H of vertical wall section (mm) | End flange width (mm) | Shape of arc | Winding of end portion | Shape of front of A end | Additional shape of top sheet section |
| Example 10 | L | 217 | 43.4 | 138 | 60 | 40 | R | No | Straight | No |
| Example 11 | L | 217 | 43.4 | 138 | 60 | 40 | R | No | Non-straight 1 | No |
| Example 12 | L | 294 | 58.8 | 138 | 60 | 40 | R | No | Non-straight 2 | No |
| Example 13 | L | 217 | 43.4 | 138 | 60 | 40 | R | No | Non-straight 3 | Yes |
| Example 14 | L | 217 | 43.4 | 138 | 10 | 40 | R | No | Straight | No |

TABLE 2B

| | Shape | | | | | | | | | |
|---|---|---|---|---|---|---|---|---|---|---|
| | Top sheet shape | Arc length (mm) | Arc length × 0.2 | Radius of curvature of maximum curvature portion of arc (mm) | Height H of vertical wall section (mm) | End flange width (mm) | Shape of arc | Winding of end portion | Shape of front of A end | Additional shape of top sheet section |
| Example 15 | L | 217 | 43.4 | 138 | 15 | 40 | R | No | Straight | No |
| Example 16 | L | 217 | 43.4 | 138 | 20 | 40 | R | No | Straight | No |
| Example 17 | L | 217 | 43.4 | 138 | 30 | 40 | R | No | Straight | No |
| Example 18 | L | 66 | 13.2 | 42 | 5 | 25 | R | No | Straight | No |
| Example 19 | L | 66 | 13.2 | 42 | 14 | 25 | R | No | Straight | No |
| Example 20 | L | 66 | 13.2 | 42 | 18 | 25 | R | No | Straight | No |
| Example 21 | L | 66 | 13.2 | 42 | 14 | 25 | R | No | Straight | No |
| Example 22 | L | 66 | 13.2 | 42 | 14 | 25 | R | No | Straight | No |
| Example 23 | L | 66 | 13.2 | 42 | 14 | 25 | R | No | Straight | No |
| Example 24 | L | 217 | 43.4 | 138 | 60 | 20 | R | No | Straight | No |
| Example 25 | L | 217 | 43.4 | 138 | 60 | 25 | R | No | Straight | No |
| Example 26 | L | 217 | 43.4 | 138 | 60 | 80 | R | No | Straight | No |
| Example 27 | L | 217 | 43.4 | 138 | 60 | 100 | R | No | Straight | No |
| Example 28 | L | 217 | 43.4 | 138 | 60 | 120 | R | No | Straight | No |
| Example 29 | L | 108 | 21.6 | 3 | 60 | 40 | R + Straight + R | No | Straight | No |
| Example 30 | L | 110 | 22 | 5 | 60 | 40 | R + Straight + R | No | Straight | No |
| Example 31 | L | 113 | 22.6 | 10 | 60 | 40 | R + Straight + R | No | Straight | No |
| Example 32 | L | 121 | 24.2 | 20 | 60 | 40 | R + Straight + R | No | Straight | No |
| Example 33 | L | 268 | 53.6 | 200 | 60 | 40 | R | No | Straight | No |
| Example 34 | L | 295 | 59 | 250 | 60 | 40 | R | No | Straight | No |
| Example 35 | L | 323 | 64.6 | 300 | 60 | 40 | R | No | Straight | No |
| Example 36 | L | 343 | 68.6 | 350 | 60 | 40 | R | No | Straight | No |
| Example 37 | T 1 | 217 | 43.4 | 138 | 60 | 40 | R | No | Straight | No |
| Example 38 | T 1 | 217 | 43.4 | 138 | 60 | 40 | R | No | Straight | No |
| Example 39 | T 2 | 181 | 36.2 | 138 | 60 | 40 | R | No | Straight | No |
| Example 40 | Y | 181 | 36.2 | 138 | 60 | 40 | R | No | Straight | No |

TABLE 3A

| | Forming condition | | | | | | |
|---|---|---|---|---|---|---|---|
| | Pressurized position | | | | | | |
| | Area F of top sheet section | Other than area F of top sheet section | Pressurized range from boundary line | Pre-processing | Forming load (ton) | Pad load pressure MPa | Ratio of clearance between pad and die to sheet thickness |
| Example 1 | Entire surface | Entire surface | 8 mm or greater | No | 200 | 3.8 | — |
| Example 2 | Entire surface | Entire surface | 8 mm or greater | No | 200 | 0.1 | — |
| Example 3 | Entire surface | Entire surface | 8 mm or greater | No | 200 | 35.0 | — |
| Example 41 | Entire surface | Entire surface | 8 mm or greater | No | 200 | 10.0 | — |
| Example 42 | Entire surface | Entire surface | 8 mm or greater | No | 200 | 0.1 | — |
| Example 43 | Entire surface | Entire surface | 8 mm or greater | No | 150 | 32.0 | — |
| Example 44 | Entire surface | Entire surface | 8 mm or greater | No | 150 | 32.0 | — |
| Example 45 | Entire surface | Entire surface | 8 mm or greater | No | 200 | — | 1.00 |
| Example 46 | Entire surface | Entire surface | 8 mm or greater | No | 200 | — | 1.02 |
| Example 47 | Entire surface | Entire surface | 8 mm or greater | No | 200 | — | 1.03 |
| Example 48 | Entire surface | Entire surface | 8 mm or greater | No | 200 | — | 1.09 |
| Example 49 | Entire surface | Entire surface | 8 mm or greater | No | 200 | — | 1.80 |

TABLE 3A-continued

| | Forming condition | | | | | | |
|---|---|---|---|---|---|---|---|
| | Pressurized position | | | | | | |
| | Area F of top sheet section | Other than area F of top sheet section | Pressurized range from boundary line | Pre-processing | Forming load (ton) | Pad load pressure MPa | Ratio of clearance between pad and die to sheet thickness |
| Example 50 | Entire surface | Entire surface | 8 mm or greater | No | 200 | — | 1.00 |
| Example 51 | Entire surface | Entire surface | 8 mm or greater | No | 200 | — | 1.07 |
| Example 52 | Entire surface | Entire surface | 8 mm or greater | No | 200 | — | 2.00 |
| Example 4 | — | Entire surface | 8 mm or greater | No | 200 | 3.9 | — |
| Example 5 | Entire surface | Partial | 8 mm or greater | No | 200 | 6.2 | — |
| Example 6 | Entire surface | Entire surface | 8 mm or greater | No | 200 | 3.8 | — |
| Example 7 | Entire surface | Entire surface | 8 mm or greater | No | 300 | 3.8 | — |
| Example 8 | Entire surface | Entire surface | 8 mm or greater | No | 200 | 3.8 | — |
| Example 9 | Entire surface | Entire surface | 8 mm or greater | No | 400 | 5.1 | — |
| Example 10 | Entire surface | Entire surface | 8 mm or greater | No | 450 | 4.7 | — |
| Example 11 | Entire surface | Entire surface | 8 mm or greater | No | 200 | 3.8 | — |
| Example 12 | Entire surface | Entire surface | 8 mm or greater | No | 200 | 3.8 | — |
| Example 13 | Partial | Partial | 8 mm or greater | No | 200 | 6.0 | — |
| Example 14 | Entire surface | Entire surface | 8 mm or greater | No | 150 | 3.0 | — |

TABLE 3B

| | Forming condition | | | | | | |
|---|---|---|---|---|---|---|---|
| | Pressurized position | | | | | | |
| | Area F of top sheet section | Other than area F of top sheet section | Pressurized range from boundary line | Pre-processing | Forming load (ton) | Pad load pressure MPa | Ratio of clearance between pad and die to sheet thickness |
| Example 15 | Entire surface | Entire surface | 8 mm or greater | No | 150 | 3.0 | — |
| Example 16 | Entire surface | Entire surface | 8 mm or greater | No | 150 | 3.0 | — |
| Example 17 | Entire surface | Entire surface | 8 mm or greater | No | 150 | 3.0 | — |
| Example 18 | Entire surface | Entire surface | 8 mm or greater | No | 150 | 3.0 | — |
| Example 19 | Entire surface | Entire surface | 8 mm or greater | No | 150 | 3.0 | — |
| Example 20 | Entire surface | Entire surface | 8 mm or greater | No | 150 | 3.0 | — |
| Example 21 | Partial | Partial | Within 3 mm | No | 150 | 6.2 | — |
| Example 22 | Partial | Partial | Within 5 mm | No | 150 | 6.2 | — |
| Example 23 | Partial | Partial | Within 8 mm | No | 150 | 6.2 | — |
| Example 24 | Entire surface | Entire surface | 8 mm or greater | No | 200 | 3.8 | — |
| Example 25 | Entire surface | Entire surface | 8 mm or greater | No | 200 | 3.8 | — |
| Example 26 | Entire surface | Entire surface | 8 mm or greater | No | 200 | 3.8 | — |
| Example 27 | Entire surface | Entire surface | 8 mm or greater | No | 200 | 3.8 | — |
| Example 28 | Entire surface | Entire surface | 8 mm or greater | No | 200 | 3.8 | — |
| Example 29 | Entire surface | Entire surface | 8 mm or greater | No | 70 | 3.8 | — |
| Example 30 | Entire surface | Entire surface | 8 mm or greater | No | 70 | 3.8 | — |
| Example 31 | Entire surface | Entire surface | 8 mm or greater | No | 70 | 3.8 | — |
| Example 32 | Entire surface | Entire surface | 8 mm or greater | No | 70 | 3.8 | — |
| Example 33 | Entire surface | Entire surface | 8 mm or greater | No | 200 | 3.8 | — |
| Example 34 | Entire surface | Entire surface | 8 mm or greater | No | 200 | 3.8 | — |
| Example 35 | Entire surface | Entire surface | 8 mm or greater | No | 200 | 3.8 | — |
| Example 36 | Entire surface | Entire surface | 8 mm or greater | No | 200 | 3.8 | — |
| Example 37 | Entire surface | Entire surface | 8 mm or greater | Yes | 300 | 5.2 | — |
| Example 38 | Entire surface | Entire surface | 8 mm or greater | Yes | 150 | 1.4 | — |
| Example 39 | Entire surface | Entire surface | 8 mm or greater | Yes | 300 | 5.2 | — |
| Example 40 | Entire surface | Entire surface | 8 mm or greater | Yes | 300 | 5.2 | — |

TABLE 4A

| | Evaluation | | | | |
|---|---|---|---|---|---|
| | Wrinkle evaluation of flange section | Crack evaluation of flange section | Wrinkle evaluation of top sheet section | Crack evaluation of top sheet section | Wrinkle evaluation of vertical wall section |
| Example 1 | A | ○ | A | ○ | A |
| Example 2 | A | ○ | D | ○ | B |
| Example 3 | A | x | A | ○ | A |
| Example 41 | A | ○ | A | ○ | A |
| Example 42 | A | ○ | D | ○ | B |

TABLE 4A-continued

| | Evaluation | | | | |
|---|---|---|---|---|---|
| | Wrinkle evaluation of flange section | Crack evaluation of flange section | Wrinkle evaluation of top sheet section | Crack evaluation of top sheet section | Wrinkle evaluation of vertical wall section |
| Example 43 | A | x | A | ○ | A |
| Example 44 | A | x | A | ○ | A |
| Example 45 | A | ○ | A | ○ | A |
| Example 46 | A | ○ | A | ○ | A |
| Example 47 | A | ○ | A | ○ | A |

TABLE 4A-continued

| | Evaluation | | | | |
|---|---|---|---|---|---|
| | Wrinkle evaluation of flange section | Crack evaluation of flange section | Wrinkle evaluation of top sheet section | Crack evaluation of top sheet section | Wrinkle evaluation of vertical wall section |
| Example 48 | A | ○ | C | ○ | B |
| Example 49 | A | ○ | x | ○ | C |
| Example 50 | A | ○ | A | ○ | A |
| Example 51 | A | ○ | C | ○ | A |
| Example 52 | A | ○ | x | ○ | C |
| Example 4 | A | ○ | D | ○ | B |
| Example 5 | A | ○ | A | ○ | A |
| Example 6 | A | x | B | ○ | B |
| Example 7 | A | ○ | A | ○ | A |
| Example 8 | A | ○ | A | ○ | A |
| Example 9 | A | ○ | A | ○ | A |
| Example 10 | A | ○ | A | ○ | A |
| Example 11 | A | ○ | A | ○ | A |
| Example 12 | A | ○ | A | ○ | A |
| Example 13 | A | ○ | A | ○ | A |
| Example 14 | A | ○ | A | ○ | C |

TABLE 4B

| | Evaluation | | | | |
|---|---|---|---|---|---|
| | Wrinkle evaluation of flange section | Crack evaluation of flange section | Wrinkle evaluation of top sheet section | Crack evaluation of top sheet section | Wrinkle evaluation of vertical wall section |
| Example 15 | A | ○ | A | ○ | C |
| Example 16 | A | ○ | A | ○ | A |
| Example 17 | A | ○ | A | ○ | A |
| Example 18 | A | ○ | A | ○ | C |
| Example 19 | A | ○ | A | ○ | A |
| Example 20 | A | ○ | A | ○ | A |
| Example 21 | A | ○ | D | ○ | A |
| Example 22 | A | ○ | B | ○ | A |
| Example 23 | A | ○ | A | ○ | A |
| Example 24 | A | Δ | A | ○ | A |
| Example 25 | A | ○ | A | ○ | A |
| Example 26 | A | ○ | A | ○ | A |
| Example 27 | B | ○ | A | ○ | A |
| Example 28 | D | ○ | A | Δ | A |
| Example 29 | A | ○ | A | ○ | D |
| Example 30 | A | ○ | A | ○ | B |
| Example 31 | A | ○ | A | ○ | A |
| Example 32 | A | ○ | A | ○ | A |
| Example 33 | A | ○ | A | ○ | A |
| Example 34 | A | ○ | A | ○ | B |
| Example 35 | A | ○ | A | ○ | B |
| Example 36 | A | ○ | A | ○ | D |
| Example 37 | A | ○ | A | ○ | A |
| Example 38 | A | ○ | A | ○ | A |
| Example 39 | A | ○ | A | ○ | A |
| Example 40 | A | ○ | A | ○ | A |

In Examples 1 and 41, a formed body shown in FIG. 11 was press-formed by employing an appropriate forming condition. No crack and wrinkle was generated in the formed body.

In Examples 2 and 42, the formed body shown in FIG. 11 was press-formed by setting the pad load pressure to be lower than that of Example 1. In the formed body, wrinkles were generated in the top sheet section and small wrinkles were generated in the vertical wall section. However, since no crack was generated, there was no problem with product strength.

In Examples 3, 43, and 44, the formed bodies shown in FIG. 11 were press-formed by setting the pad load pressure to be higher than that of Example 1. Accordingly, the blank metal sheet could not sufficiently slide (perform in-plane movement) in the pressurized position, and cracks were generated in the flange section.

In Examples 45 to 52, the formed bodies shown in FIG. 11 were press-formed by setting the ratio of the clearance between the pad and the die to the sheet thickness (the clearance between the pad and the die/the sheet thickness) to 1.00 to 2.00. As a result, in Example 49 in which the ratio of the clearance between the pad and the die to the sheet thickness is set to 1.80 and in Example 52 in which the ratio of the clearance between the pad and the die to the sheet thickness is set to 2.00, buckling deformation had occurred in the top sheet section, so that a desired product shape could not be obtained.

In Example 4, a formed body shown in FIG. 12 was press-formed by pressurizing an area other than the out-of-plane deformation suppressing area (the area F) with the pad. In the formed body, significant wrinkles were generated in the top sheet section, and small wrinkles were generated in the vertical wall section. However, since no crack was generated, there was no problem with product strength.

In Example 5, a formed body shown in FIG. 13 was press-formed by pressurizing an area including the entire out-of-plane suppressing area (the area F) with the pad. In the formed body, no wrinkle and crack was generated.

In Example 6, a formed body shown in FIG. 14 was press-formed. In this example, as shown in FIG. 14, since the end portion of the part corresponding to the out-of-plane formation suppressing (the area F) does not exist on the same plane as the top sheet section, that is, since the end portion is wound, cracks were generated in the flange section.

In Examples 7 to 10, formed bodies shown in FIGS. 15, 16, 17, and 18 were press-formed. In these examples, even when the arc is elliptical (Example 7), the arc has a plurality of curvatures (R) (Example 8), the arc has a straight portion (Example 9), or the front end of the arc is the end portion of the bent section (Example 10), it could be seen that the effects of the invention were sufficiently obtained.

In Examples 11 to 13, formed bodies shown in FIGS. 19, 20, and 21 were press-formed. In these examples, according to the product designs, even when the shape of the front of the A end is non-straight (Examples 11 and 13), or the top sheet section has an additional shape (Example 13), it could be seen that the effects of the invention were sufficiently obtained. Particularly, in Example 13, even when the entire out-of-plane deformation suppressing area (the area F) could not be pressurized by the pad since a small additional shape existed in a part of the out-of-plane deformation suppressing area (the area F), it could be seen that the effects of the invention were obtained.

In Examples 14 to 17, formed bodies shown in FIG. 22 were press-formed by setting the height H of the vertical wall section to 10 mm (Example 14), 15 mm (Example 15), 20 mm (Example 16), and 30 mm (Example 17). In these examples, it could be seen that wrinkles of the vertical wall section could be suppressed by setting the height H of the vertical wall section to 20 mm or larger. In Examples 14 and 15 in which the heights of the vertical wall sections were smaller than 20 mm, wrinkles were generated in the vertical wall sections. However, since no crack was generated, there was no problem with product strength.

In Examples 18 to 20, formed bodies shown in FIG. 23 were press-formed by setting the height H of the vertical wall section to 5 mm (Example 18), 14 mm (Example 19), and 18 mm (Example 20) after setting the arc length to 66 mm (arc length×0.2=13.2). In this example, it could be seen that by setting the height H of the vertical wall section to be equal to or larger than 0.2 times the arc length, wrinkles of the vertical wall section could be suppressed even though the height of the vertical wall section was smaller than 20 mm. In Example 18 in which the height H of the vertical wall section is smaller than 0.2 times the arc length, wrinkles were generated in the vertical wall section. However, since no crack was generated, there was no problem with product strength.

In Example 21 to 23, formed bodies shown in FIGS. 24, 25, and 26 were press-formed by pressurizing, in a part which contacts with a boundary line between the top sheet section and the part curved in the arc shape of the bent section, an area within 3 mm (Example 21), 5 mm (Example 22), or 8 mm (Example 23) from the boundary line, with the pad. In these examples, it could be seen that by pressurizing the area within at least 5 mm from the boundary line with the pad, generation of wrinkles in the top sheet section could be suppressed.

In Examples 24 to 28, formed bodies shown in FIG. 27 were press-formed by setting the flange width at the A end to 20 mm (Example 24), 25 mm (Example 25), 80 mm (Example 26), 100 mm (Example 27), and 120 mm (Example 28). In these examples, it could be seen that by setting the flange width to be in the range of 25 mm to 100 mm, generation of wrinkles and cracks could be suppressed. In Example 24, necking had occurred in the flange section by setting the flange width to 20 mm, and in Example 28, significant wrinkles were generated in the flange section and necking had occurred in the top sheet section by setting the flange width to 120 mm. However, since no crack was exhibited, there was no significant problem with strength characteristics.

In Examples 29 to 32, formed bodies shown in FIG. 28 were press-formed by setting the radius of curvature of the maximum curvature portion of the arc to 3 mm (Example 29), 5 mm (Example 30), 10 mm (Example 31), and 20 mm (Example 31) when the arc has a straight portion (R+Straight+R). In these examples, it could be seen that by setting the radius of curvature of the maximum curvature portion of the arc to be equal to or larger than 5 mm, wrinkles of the vertical wall section could be suppressed.

In Examples 33 to 36, formed bodies were press-formed by setting the maximum radius of curvature of the arc to 200 mm (Example 33), 250 mm (Example 34), 300 mm (Example 35), and 350 mm (Example 36). In these examples, it could be seen that by setting the radius of curvature of the maximum curvature portion of the arc to be 300 mm or smaller, generation of wrinkles of the vertical wall section could be suppressed.

In Examples 37 and 38, a T-shaped formed body shown in FIG. 30 was press-formed. As the blank metal sheet, a steel sheet (Example 37) obtained by pre-processing the shape shown in FIG. 33 and a pre-processed aluminum sheet (Example 38) were used. In these examples, it could be seen that the press-forming method according to the invention could be employed for forming the T-shaped formed body, and the blank metal sheet according to the invention was not limited to the steel sheet.

In Examples 39 and 40, a T-shaped formed body shown in FIG. 31, which is left-right asymmetric (Example 39), and a Y-shaped formed body shown in FIG. 32 (Example 40) were press-formed. In these examples, it could be seen that the press-forming method according to the invention could be adequately applied to forming of a formed body having a shape of one or more L characters.

INDUSTRIAL APPLICABILITY

According to the invention, even when the blank metal sheet having low ductility and high strength is used, the component having the L shape can be press-formed while suppressing generation of wrinkles and cracks.

REFERENCE SIGNS LIST

10 L-shaped component
11 top sheet section
12 vertical wall section
13 flange section
15 bent section
15*a* part curved in an arc shape
50 die unit
51 die
52 pad
53 bending die
100 framework structure
110 framework member
110' framework member
111 top sheet section
112 vertical wall section
113 flange section
120 framework member
130 framework member
140 framework member
201 die
202 punch
203 blank holder
300 component
300A blank metal sheet
300B formed body
S steel sheet (blank metal sheet)
$h_i$ flange width
H height of vertical wall section

What is claimed is:

1. A forming method that forms a press component with an L shape from a blank metal sheet, the press component having a top sheet section and a vertical wall section, that comprises a bent section, which is connected to the top sheet section via said bent section having a portion curved in an arc shape and which has a flange section on an opposite side to the bent section, the top sheet section being arranged at an outside of the arc of the vertical wall section, and the flange section having an edge, the method comprising:

disposing a first portion of the blank metal sheet between a pad and a portion of a die corresponding to the top sheet section, and disposing a second portion of the blank metal sheet which is different in position from the first portion of the blank metal sheet between a bending die and a portion of the die corresponding to the flange section; and forming the vertical wall section and the flange section while an edge of the blank metal sheet corresponding to a bottommost edge of the L shape is caused to slide on the portion of the die corresponding to the top sheet section by vertically moving the bending die closer to the die, the forming of the vertical wall section and the flange section being performed in a state where:

the pad puts pressure on at least a portion of the blank metal sheet which is put on the portion of the die corresponding to the top sheet section so as to provide an out-of-plane deformation suppressing area between the pad and the die;

the edge of the blank metal sheet corresponding to the bottommost edge of the L shape is arranged on a same plane as the portion of the blank metal sheet which is put on the portion of the die corresponding to the top sheet section; and a portion of the blank metal sheet corresponding to the flange section includes a portion of an edge of the blank metal sheet.

2. The forming method according to claim 1, wherein the out-of-plane deformation suppressing area is, among areas of the top sheet section divided by a tangent line of a boundary line between the bent section and the top sheet section, the tangent line being defined at a first end portion which is one end portion of the portion curved in the arc shape of the bent section when viewed in a direction perpendicular to a surface of the top sheet section, an area of the blank metal sheet which contacts with the portion of the die corresponding to the top sheet section on a side including a second end portion which is other end portion of the portion curved in the arc shape of the bent section.

3. The forming method according to claim 2, wherein, in the flange section, in a portion of the vertical wall section connected to the portion curved in the arc shape of the bent section, widths of a flange portion of the first end portion side from a center portion in a longitudinal direction of the flange section of the portion connected to the opposite side to the top sheet section and a flange portion in front of the flange portion of the first end portion side by 50 mm or larger are equal to or larger than 25 mm and equal to or smaller than 100 mm.

4. The forming method according to claim 1, wherein, in the edge of the blank metal sheet, among edges of a portion of the blank metal sheet corresponding to the out-of-plane deformation suppressing area, an edge of the blank metal sheet which becomes an edge of a portion on the top sheet section side further than the bent section is on the same plane as the top sheet section.

5. The forming method according to claim 1, wherein the top sheet section has an L shape, a T shape, or a Y shape.

6. The forming method according to claim 1, wherein a height of the vertical wall section is equal to or larger than 0.2 times a length of the portion curved in the arc shape of the bent section, or equal to or larger than 20 mm.

7. The forming method according to claim 1, wherein:

the forming of the vertical wall section and the flange section is performed so that the pad is brought close to or is brought into contact with a region of the blank metal sheet; and the region of the blank metal sheet is, among portions of the top sheet section, a portion which is in contact with a boundary line between the top sheet section and the portion curved in the arc shape of the bent section, and which is within at least 5 mm from the boundary line.

8. The forming method according to claim 1, wherein a radius of curvature of a maximum curvature portion of a boundary line between the portion curved in the arc shape of the bent section and the top sheet section is equal to or larger than 5 mm and equal to or smaller than 300 mm.

9. The forming method according to claim 1, wherein a pre-processed blank metal sheet is press-formed as the blank metal sheet.

10. The forming method according to claim 1, wherein a blank metal sheet having a breaking strength of equal to or higher than 400 MPa and equal to or lower than 1,600 MPa is used as the blank metal sheet.

11. A forming method that forms a press component with an L shape, comprising:

performing forming by the method according to claim 1 to form a shape of a single L character, a shape of a plurality of L characters, or a shape of any L character, when a shape having a plurality of L characters is press-formed.

12. The forming method according to claim 1, wherein the pad and the portion of the die corresponding to the top sheet section allow the blank metal sheet to move only in a direction parallel to one plane.

13. The forming method according to claim 1, wherein the pad puts the pressure on at least the area in the portion of the blank metal sheet which is put on the portion of the die corresponding to the top sheet section without adding a dent to the blank metal sheet.

14. The forming method according to claim 1, wherein a surface of the pad faces a surface of the portion of the die corresponding to the top sheet section with the blank metal sheet between the surface of the pad and the surface of the portion of the die corresponding to the top sheet section, and the surface of the pad and the surface of the portion of the die corresponding to the top sheet section are flat.

15. The forming method according to claim 1, wherein the die, the bending die, and the pad are separable from each other.

16. A forming method that forms a press component with an L shape from a blank metal sheet, the press component having a top sheet section and a vertical wall section, that comprises a bent section, which is connected to the top sheet section via said bent section having a portion curved in an arc shape and which has a flange section on an opposite side to the bent section, the top sheet section being arranged at an outside of the arc of the vertical wall section, and the flange section having an edge, the method comprising:

disposing a first portion of the blank metal sheet between a pad and a portion of a die corresponding to the top sheet section, and disposing a second portion of the blank metal sheet which is different in position from the first portion of the blank metal sheet between a bending die and a portion of the die corresponding to the flange section; and forming the vertical wall section and the flange section while an edge of the blank metal sheet corresponding to a bottommost edge of the L shape is caused to slide on the portion of the die corresponding to the top sheet section by vertically moving the bending die closer to the die, the forming of the vertical wall section and the flange section being performed in a state where:

the pad is brought close to or is bought into contact with at least a part a portion of the blank metal sheet which is put on the portion of the die corresponding to the top sheet section so that a distance between a surface of the pad and a surface of the die which faces the surface of the pad is equal to or larger than a thickness of the blank metal sheet and is maintained to be equal to or smaller than 1.1 times the thickness of the blank metal sheet so as to provide an out-of-plane deformation suppressing area between the pad and the die;

the edge of the blank metal sheet corresponding to the bottommost edge of the L shape is arranged on a same plane as the portion of the blank metal sheet which is put on the portion of the die corresponding to the top sheet section; and a portion of the blank metal sheet corresponding to the flange section includes a portion of an edge of the blank metal sheet.

17. The forming method according to claim 16, wherein the out-of-plane deformation suppressing area is, among areas of the top sheet section divided by a tangent line of a boundary line between the bent section and the top sheet section, the tangent line being defined at a first end portion which is one end portion of the portion curved in the arc shape of the bent section when viewed in a direction perpendicular to a surface of the top sheet section, an area of the blank metal sheet which contacts with the portion of the die corresponding to the top sheet section on a side including a second end portion which is other end portion of the portion curved in the arc shape of the bent section.

18. The forming method according to claim 16, wherein, in the edge of the blank metal sheet, among edges of a portion of the blank metal sheet corresponding to the out-of-plane deformation suppressing area, an edge of the blank metal sheet corresponding to which becomes an edge of a portion on the top sheet section side further than the bent section is on the same plane as the top sheet section.

19. The forming method according to claim 16, wherein the top sheet section has an L shape, a T shape, or a Y shape.

20. The forming method according to claim 16, wherein a height of the vertical wall section is equal to or larger than 0.2 times a length of the portion curved in the arc shape of the bent section, or equal to or larger than 20 mm.

21. The forming method according to claim 16, wherein:

the forming of the vertical wall section and the flange section is performed so that the pad is brought close to or is brought into contact with a region of the blank metal sheet; and the region of the blank metal sheet is, among portions of the top sheet section, a portion which is in contact with a boundary line between the top sheet section and the portion curved in the arc shape of the bent section, and which is within at least 5 mm from the boundary line.

22. The forming method according to claim 16, wherein a radius of curvature of a maximum curvature portion of a boundary line between the portion curved in the arc shape of the bent section and the top sheet section is equal to or larger than 5 mm and equal to or smaller than 300 mm.

23. The forming method according to claim 16, wherein a pre-processed blank metal sheet is press-formed as the blank metal sheet.

24. The forming method according to claim 16, wherein a blank metal sheet having a breaking strength of equal to or higher than 400 MPa and equal to or lower than 1,600 MPa is used as the blank metal sheet.

25. A forming method that forms a press component with an L shape, comprising:

performing forming by the method according to claim 16 to form a shape of a single L character, a shape of a plurality of L characters, or a shape of any L character, when a shape having a plurality of L characters is press-formed.

26. The forming method according to claim 16, wherein the pad and the portion of the die corresponding to the top sheet section allow the blank metal sheet to move only in a direction parallel to one plane.

27. The forming method according to claim 16, wherein the pad puts the pressure on at least the area in the portion of the blank metal sheet which is put on the portion of the die corresponding to the top sheet section without adding a dent to the blank metal sheet.

28. The forming method according to claim 16, wherein a surface of the pad faces a surface of the portion of the die corresponding to the top sheet section with the blank metal sheet between the surface of the pad and the surface of the portion of the die corresponding to the top sheet section, and the surface of the pad and the surface of the portion of the die corresponding to the top sheet section are flat.

29. The forming method according to claim 16, wherein the die, the bending die, and the pad are separable from each other.

* * * * *